US008430251B2

(12) United States Patent
Fry et al.

(10) Patent No.: US 8,430,251 B2
(45) Date of Patent: Apr. 30, 2013

(54) TUBE RELOAD SYSTEM AND COMPONENTS

(75) Inventors: Kenneth Charles Fry, San Diego, CA (US); Scott Edward Curry, San Marcos, CA (US)

(73) Assignee: Genesee Scientific Corporation, San Diego, CA (US)

( * ) Notice: Subject to any disclaimer, the term of this patent is extended or adjusted under 35 U.S.C. 154(b) by 0 days.

(21) Appl. No.: 13/370,236

(22) Filed: Feb. 9, 2012

(65) Prior Publication Data

US 2012/0138552 A1 Jun. 7, 2012

Related U.S. Application Data

(63) Continuation of application No. 12/418,358, filed on Apr. 3, 2009, now Pat. No. 8,136, 679.

(60) Provisional application No. 61/149,615, filed on Feb. 3, 2009.

(51) Int. Cl.
*A47G 29/00* (2006.01)

(52) U.S. Cl.
USPC ..... 211/85.18

(58) Field of Classification Search ..... 211/85.13, 211/85.18, 74, 85, 59.4, 126.12; 206/449, 206/486, 505–509, 443, 446, 562–564, 503; 220/513, 516, 518, 519, 23.2, 23.8, 526; 108/57.31, 57.25, 57.22; 422/100, 99, 102, 422/104, 562, 569; 215/355
See application file for complete search history.

(56) References Cited

U.S. PATENT DOCUMENTS

| | | | | | |
|---|---|---|---|---|---|
| 2,120,610 | A | * | 6/1938 | Howard | 211/74 |
| 2,771,399 | A | * | 11/1956 | Savage | 435/33 |
| 3,836,329 | A | * | 9/1974 | Jordan | 436/49 |
| 3,853,217 | A | | 12/1974 | Scordato et al. | |
| 4,142,633 | A | | 3/1979 | Raghavachari et al. | |
| 4,154,795 | A | * | 5/1979 | Thorne | 422/553 |
| D264,810 | S | | 6/1982 | Voltmann | |
| 4,346,057 | A | * | 8/1982 | Bowser | 422/528 |
| D271,239 | S | | 11/1983 | Lemieux et al. | |
| D276,071 | S | | 10/1984 | Malinoff | |
| 4,495,150 | A | * | 1/1985 | Cook et al. | 422/527 |
| D283,162 | S | | 3/1986 | Godsey | |
| 4,773,554 | A | * | 9/1988 | Warwick | 220/516 |
| D302,207 | S | | 7/1989 | Matkovich | |
| 5,048,957 | A | * | 9/1991 | Berthold et al. | 356/246 |
| 5,065,923 | A | * | 11/1991 | Hoefer et al. | 220/694 |
| 5,071,026 | A | * | 12/1991 | Apps | 220/516 |

(Continued)

FOREIGN PATENT DOCUMENTS

| | | |
|---|---|---|
| JP | 06-043172 | 2/1994 |
| WO | WO 2010/091125 | 8/2010 |

OTHER PUBLICATIONS

International Search Report and Written Opinion mailed on Nov. 15, 2010 in International Patent Application PCT/US2010/023109 filed on Feb. 3, 2010.

(Continued)

*Primary Examiner* — Jennifer E. Novosad
(74) *Attorney, Agent, or Firm* — Grant Anderson LLP

(57) ABSTRACT

Disclosed herein is a tube loading system suitable for rapidly loading, handing, manipulation and storing large numbers of tubes.

22 Claims, 8 Drawing Sheets

U.S. PATENT DOCUMENTS 5,145,646 A * 9/1992 Tyranski ..... 422/547
D337,165 S 7/1993 Malinoff
5,324,482 A * 6/1994 Scaramella et al. ..... 422/526
D349,773 S 8/1994 Malin et al.
5,501,352 A * 3/1996 Apps ..... 220/4.26
5,673,792 A * 10/1997 Aikio ..... 206/509
5,720,406 A * 2/1998 Fassbind et al. ..... 220/23.4
5,863,791 A * 1/1999 Baldszun et al. ..... 435/288.1
D414,271 S 9/1999 Mendoza
5,950,832 A * 9/1999 Perlman ..... 206/446
5,988,394 A * 11/1999 Emoto et al. ..... 206/724
6,019,225 A 2/2000 Kalmakis et al.
6,021,913 A * 2/2000 McGrath ..... 220/513
D441,091 S 4/2001 Day
D464,734 S 10/2002 Berna et al.
6,568,544 B1 * 5/2003 Lafond et al. ..... 211/74
D477,416 S 7/2003 Roberts et al.
6,601,725 B2 * 8/2003 Lafond et al. ..... 220/23.4
6,640,981 B2 * 11/2003 Lafond et al. ..... 211/74
6,660,232 B1 * 12/2003 Krueger et al. ..... 422/552
6,752,967 B2 6/2004 Farina et al.
D492,792 S 7/2004 Kokaisel et al.
6,759,012 B2 7/2004 Haslam et al.
6,875,405 B1 4/2005 Mathus et al.
7,060,226 B1 * 6/2006 Jessop et al. ..... 422/526
D529,622 S 10/2006 Hadjis et al.
D533,948 S 12/2006 Schaub et al.
7,169,602 B2 * 1/2007 Sandell ..... 435/288.4
7,232,038 B2 * 6/2007 Whitney ..... 211/74
D562,463 S 2/2008 Berndt et al.
D574,505 S 8/2008 Muller-Cohn et al.
D574,506 S 8/2008 Monks
D598,127 S 8/2009 Lea
D608,013 S 1/2010 Coulling et al.
D610,265 S 2/2010 Lea
D620,605 S 7/2010 Reitze
7,820,115 B2 10/2010 Zatechka et al.
7,829,026 B2 * 11/2010 Su et al. ..... 422/527
D632,803 S 2/2011 Motadel et al.
7,892,504 B2 2/2011 Taike et al.
D638,953 S 5/2011 Cavada et al.
D645,156 S 9/2011 Reitze
8,136,679 B2 * 3/2012 Fry et al. ..... 211/85.18
8,221,300 B2 * 7/2012 Sherman et al. ..... 494/16
2002/0011195 A1 * 1/2002 Apps ..... 108/57.25
2002/0148837 A1 * 10/2002 Apps ..... 220/515
2002/0164270 A1 * 11/2002 Hool et al. ..... 422/64
2003/0161764 A1 * 8/2003 Itoh ..... 422/104
2005/0013734 A1 * 1/2005 Vann et al. ..... 422/63
2005/0158212 A1 * 7/2005 Yavilevich ..... 422/100
2005/0279651 A1 * 12/2005 Perret et al. ..... 206/203
2008/0056956 A1 * 3/2008 Vijay et al. ..... 422/103
2009/0065458 A1 * 3/2009 Murray ..... 211/85.18
2009/0242568 A1 * 10/2009 Apps ..... 220/516
2010/0272614 A1 * 10/2010 Bulow et al. ..... 422/104
2010/0294734 A1 * 11/2010 Taike et al. ..... 211/85.13
2011/0031147 A1 * 2/2011 Eugui ..... 206/427

OTHER PUBLICATIONS

Office Action mailed on: Jul. 17, 2012 in Design U.S. Appl. No. 29/355,175, filed Feb. 3, 2010.

* cited by examiner

FIG. 1C
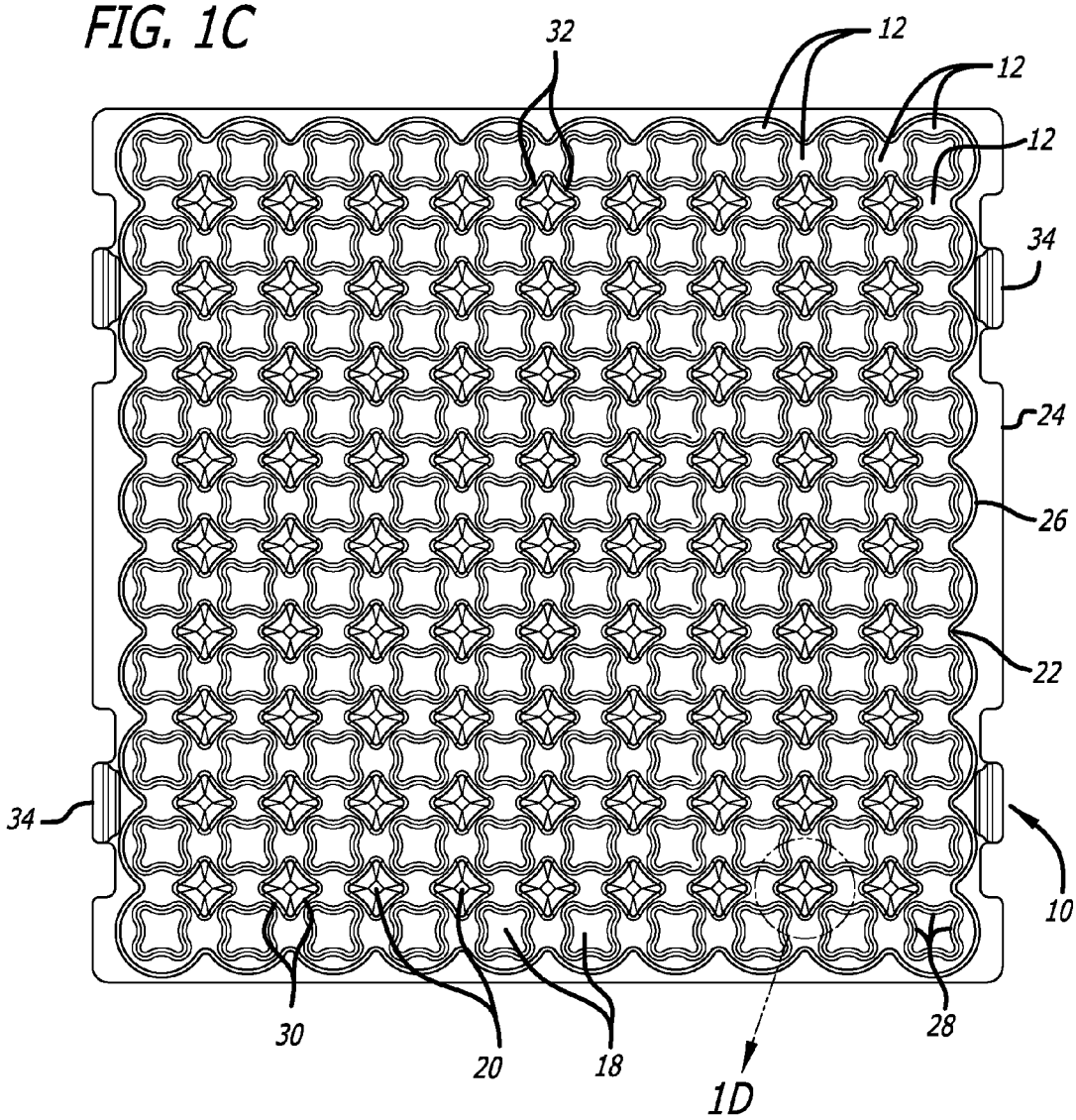
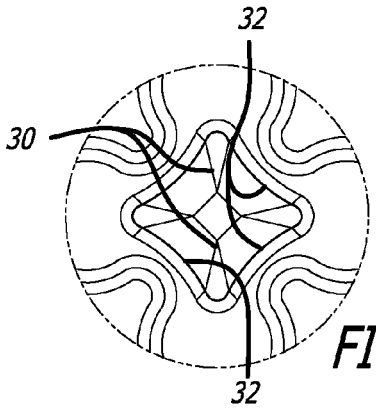
FIG. 1D

FIG. 2C
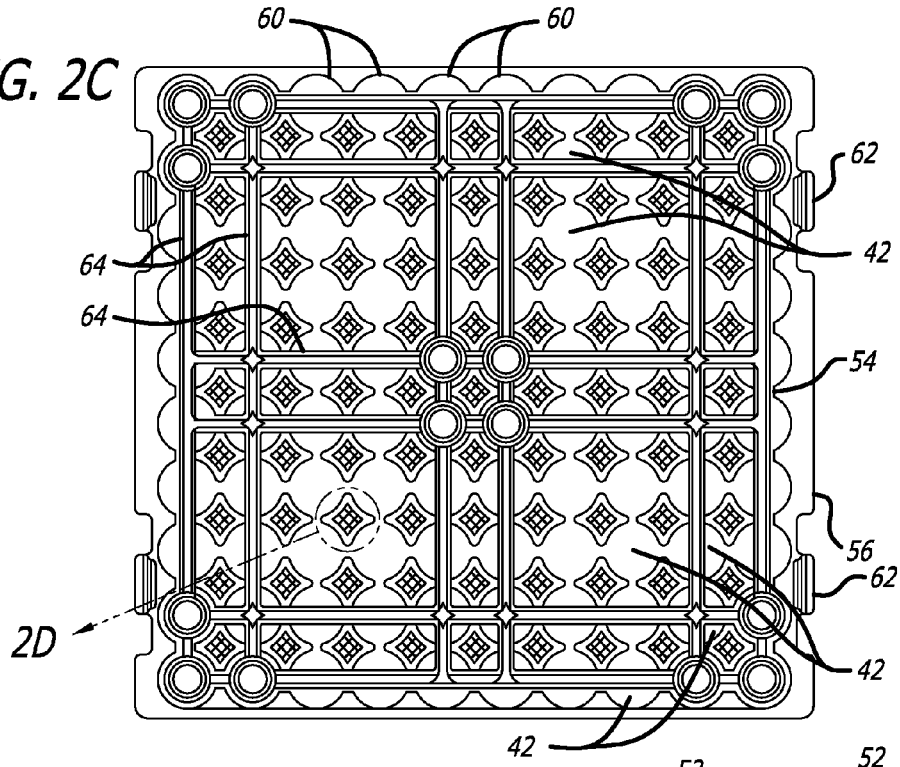
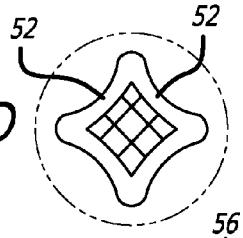
FIG. 2D
FIG. 2E
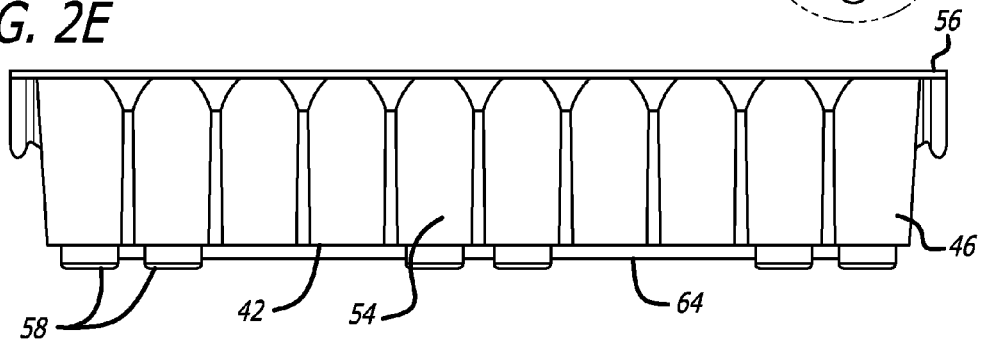
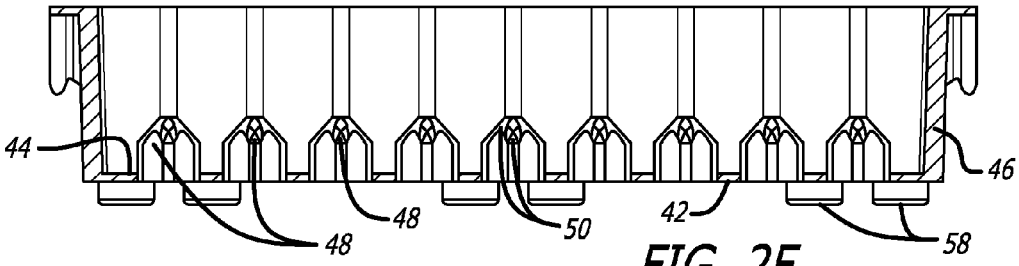
FIG. 2F

TUBE RELOAD SYSTEM AND COMPONENTS

RELATED PATENT APPLICATION

This patent application is a continuation of U.S. patent application Ser. No. 12/418,358, filed on Apr. 3, 2009, now allowed, entitled "Tube Reload System and Components", which claims the benefit of U.S. provisional patent application No. 61/149,615, filed on Feb. 3, 2009, entitled "Tube Reload System and Components". This patent application also is related to U.S. design patent application Ser. No. 29/355,175, filed on Feb. 3, 2010, entitled "Tube Reload System and Components". This patent application also is related to international patent application no. PCT/US2010/023109, filed on Feb. 3, 2010, entitled "Tube Reload System and Components". The entire content of the foregoing patent applications is hereby incorporated by reference herein, including all text and drawings.

FIELD OF THE INVENTION

The invention relates in part to systems and processes for loading, manipulating, and preparing large numbers of tubes or vials for use in manual and automated systems.

BACKGROUND

As laboratory and clinical technologies advance, an increasing number of medical and laboratory procedures are being performed by high throughput manual and automated procedures. Many laboratory or clinical processes and procedures are carried out using tubes and vials. Such procedures include blood sample collection and manipulation, cell culture growth and maintenance, organism growth and maintenance (e.g., Drosophila (fruit flies)), scintillation counting or radioactive samples, and collecting chromatography fractions, for example. In these procedures, tubes and vials often are loaded into holders or racks configured to securely hold them in place, and allow manipulation, transport and storage of the tubes or vials.

SUMMARY

Even when relatively large numbers of tubes or vials are utilized in laboratory and clinical procedures, such items often are placed in racks or holders one at a time by a human operator. This manner of tube and vial loading represents a bottleneck in the ability to rapidly load tubes or vials into holders for tube manipulation, handling and storage. Repetitive motion can adversely bear on the health of operators. Increasing the probability of such injuries, coupled with the cost associated with the time-intensive nature of such activities, ultimately drives costs upward for the overall processes.

The present invention in part addresses these problems by providing a loading system that can be used to rapidly load a large number of tubes or vials into a rack or holder. The tube loading system allows for (i) manipulation and handling of tubes or vials, and (ii) stacking and storage of large numbers of tubes or vials, for example. Components of the system can be constructed from low cost, recyclable and/or renewable materials (e.g., including recycled materials), which decreases the cost of the overall procedures that incorporate the use of the tubes and vials. The present invention also in part provides methods of use and manufacture of the tube loading system and components. For example, an operator may simply remove a top layer of tubes from a stacked set of tube layers, invert the layer of tubes, and then utilize the tubes in a laboratory procedure. Various features of components in the systems provided herein facilitate rapid use and storage of a large number of tubes and vials.

Thus, provided in part herein is a tube loading system that comprises a first layer of tubes in an array, where each tube comprises a top, a bottom and one or more walls, and a plate comprising a base having an inner surface and an outer surface, a first set of projections extending from the inner surface, and a second set of projections extending from the outer surface, where each of the projections in the first set, or portion thereof, is in effective connection with the top of each tube in the layer, and the first set of projections positions tubes of the first layer in the array.

In some embodiments the plate further comprises a sidewall extending from the inner surface of the base and surrounding the base perimeter. In certain embodiments the sidewall may be in connection with a flange that extends from the sidewall. In some embodiments a portion of the plate sidewall may be in effective contact with a wall of a tube located on the perimeter of the array. In certain embodiments the plate sidewall includes one or more curved portions, and each curved portion may have a radius of curvature that can accommodate the radius of curvature of a circular cross section tube in embodiments.

In some embodiments each projection of the first set of projections may be isolated from other projections in the first set. In certain embodiments each projection in the first set may include one or more surfaces in effective contact with the top of a tube in the first layer. In some embodiments each projection in the first set may include one or more surfaces in effective contact with an inner surface of a tube in the first layer.

In some embodiments each projection in the second set comprises one or more surfaces and a terminus opposite the base. The one or more surfaces, in certain embodiments, can taper as they extend from the base to the terminus. In certain embodiments each projection of the second set of projections is isolated from other projections in the second set. In some embodiments each projection in the second set of projections may include one or more curved surfaces having a radius of curvature that can accommodate the radius curvature of a circular cross section tube. In some embodiments each projection is conical. In certain conical projection embodiments, the projections have a flat top. Each projection may be cubical or diamond shaped in some embodiments, and diamond shaped projections can have a flat top in certain embodiments. Combinations of projection shape and terminus detail (e.g., flat top, pointed top, curved surfaces and the like), other than those listed may be used in certain embodiments. In some embodiments each projection comprises three or more axial edges (e.g., 4 axial edges). In certain embodiments where projections contain axial edges, the surfaces between axial edges may be curved, and the curved surfaces may be concave in some embodiments.

In some embodiments the base of a projection may be substantially rectangular or substantially square. In some embodiments each projection of the second set may be in effective communication with the bottom of two or more tubes in an optional second layer of tubes in stacked connection with the outer surface of the plate base. As used herein "effective communication" refers to one or more surfaces of a projection physically contacting one or more surfaces of a tube or vial and any point of time during handling of the tubes or vials by an operator.

It is possible that at one point in time projection surfaces are not in physical contact with tube surfaces, in which case the nominal, average or mean distance between projection surfaces and tube surfaces are minimal (e.g., less than about 3 millimeters, 2 millimeters, 1 millimeter, 0.9 millimeters, 0.8 millimeters, 0.7 millimeters, 0.6 millimeters, 0.5 millimeters, 0.4 millimeters, 0.3 millimeters, 0.2 millimeters, less than about 0.1 millimeter, or even about 0.01 millimeter).

In some embodiments the tubes may face downwards (i.e., open end downwards). In certain embodiments the tubes and/or plate each independently may comprise a plastic, and the plates and/or or tubes may be thermoformed or injection molded in some embodiments.

In some of the embodiments described herein, the system may comprise two or more layers of tubes ("a plurality of layers"), and in certain embodiments, there is a plate in effective communication with each layer. In certain embodiments the axial centerlines of tubes in one layer align with the axial centerlines of tubes of another layer.

Also provided in part herein is a tube loading system which comprises a tray that includes a tray base having an inner surface and an outer surface, and a first set of tray projections extending from the inner surface of the tray base, where each of the projections is in effective contact with the bottom of two or more tubes in an optional layer of tubes, and the projections position the tubes in the array. In certain embodiments the tray comprises a sidewall surrounding the perimeter of the tray base, and the tray sidewall can extend from the inner surface of the tray base in some embodiments. In certain embodiments the tray sidewall is in connection with a flange that extends from the tray sidewall. In some embodiments one or more of the trays is between one or more layers of tubes. In certain embodiments the tray is contact with the top layer of tubes.

In certain embodiments each tray projection of the first set of projections may be isolated from other tray projections in the first set. In some embodiments each tray projection in the first set of tray projections may comprise one or more surfaces and a terminus opposite the tray base, and the one or more surfaces taper as they extend from the tray base to the terminus.

In some embodiments the tray further comprises a second set of projections extending from the outer surface of the base. Each tray projection of the second set of projections may be isolated from other tray projections in the second set in certain embodiments. In some embodiments each tray projection may be conical. In certain embodiments each tray projection may comprise three or more axial edges. In some embodiments each tray projection may comprise 4 axial edges. In some embodiments with tray projections containing axial edges, the surfaces between axial edges may be curved, and the curved surfaces may be concave in certain embodiments. In some embodiments the tray may comprise a plastic, and may be thermoformed or injection molded in embodiments.

Also provided in part herein are methods for loading an array of tubes in a tray, which comprise (a) providing a first layer of tubes with a tray, where each tube comprises a top, bottom and one or more walls, the first layer of tubes is in contact with a plate comprising a base having an inner surface and an outer surface, a first set of projections extending from the inner surface and a second set of projections extending from the outer surface, each of the projections in the first set is in effective connection with the top of each tube in the first layer, each projection of the first set is isolated from other projections in the first set, the bottom of each tube in the first layer of tubes is in contact with the tray, and the top of each tube is facing downwards and the tubes are between the plate and the tray; (b) orienting the first layer of tubes with the top of each tube facing upwards, and (c) disengaging the plate from the first layer of tubes, whereby the first layer of tubes is loaded in the tray. In some embodiments there may be two or more layers of tubes and a plate for each layer of tubes, and (a), (b) and (c) may be repeated for each layer of tubes.

Certain embodiments are described further in the following description, claims, examples and drawings, and are in no way meant to limit the scope of the invention.

BRIEF DESCRIPTION OF THE DRAWINGS

The drawings illustrate certain non-limiting embodiments of the invention. For clarity and ease of illustration, drawings are not necessarily to scale, and in some instances, various elements may be shown exaggerated or enlarged to facilitate an understanding of particular embodiments.

FIG. 1C is an illustration of a view looking down at the top of a tube holding system plate of the present invention.

FIG. 1D is an enlarged detail drawing of the circled area of FIG. 1C.

FIG. 2C is an illustration of a view looking down at the bottom of a tube holding system tray of the present invention.

FIG. 2D is an enlarged detail drawing of the circled area of FIG. 2C.

FIG. 2E is a side elevation drawing of a tube holding system tray of the present invention. Line A represents cross section taken and illustrated in FIG. 2F. The portion of the tube holding system tray above line A is also removed in the cross sectional drawing illustrated in FIG. 2F.

FIG. 2F is a side elevation cross-sectional drawing taken along line A of FIG. 2E, showing additional inner surface projection detail of a tube holding system tray of the present invention.

In FIG. 4A the side view includes a plurality of tubes arranged on the perimeter of the tube reload system.

DETAILED DESCRIPTION

Figure 1A:
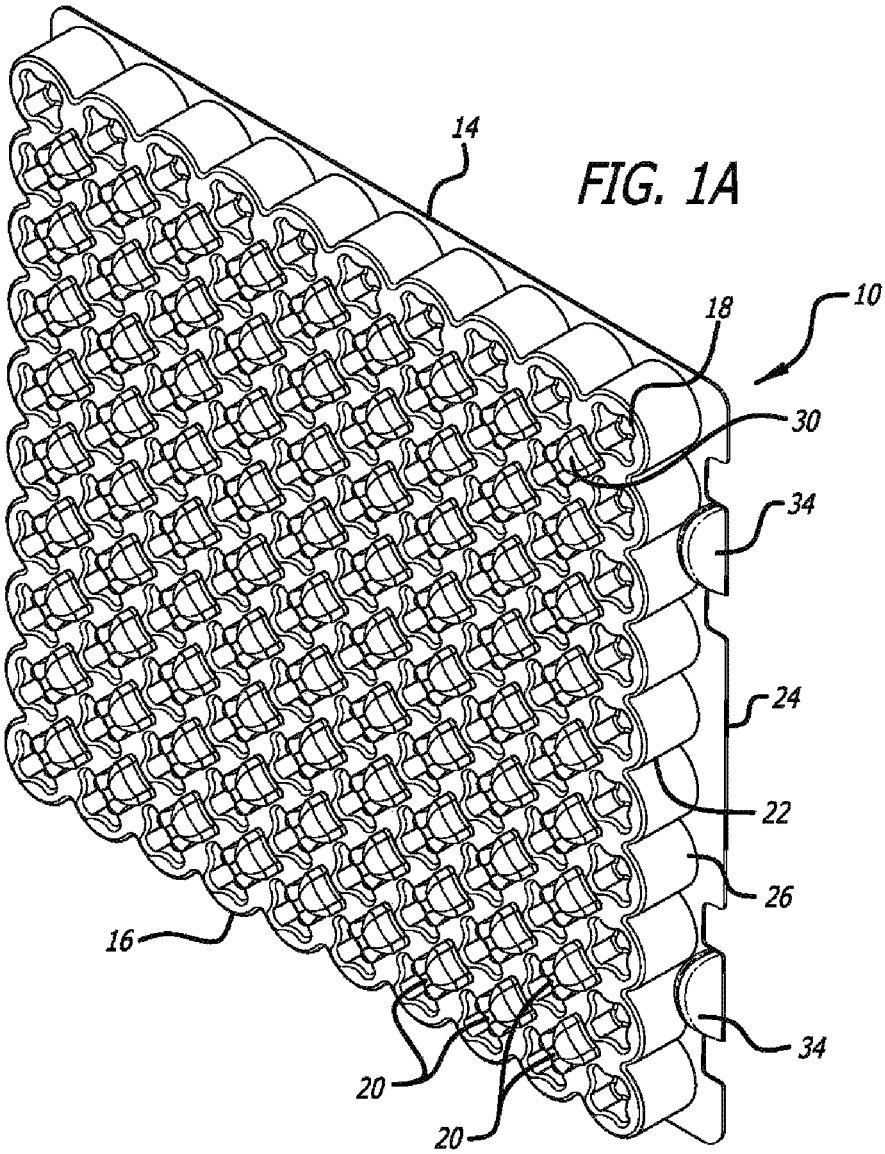
FIG. 1A is a top or outer surface perspective drawing of a tube holding system plate of the present invention.

Certain laboratory procedures require the use of multiple tubes or vials. Examples of laboratory procedures include, without limitation, growth and maintenance of cell cultures; isolation, preparation and analysis of biomolecules (e.g., using chips or arrays or other solid supports); scintillation counting; collecting chromatographic fractions; detecting photon release from fluorescent molecules; collection and processing of blood samples; and growth and maintenance of insects in vials (e.g., Drosophila). Current methods often involve a human operator loading one tube, or at most a few tubes, at a time into a holder, for subsequent preparation or manipulation. Tube loading systems provided herein provide cost effective, labor saving, health conscious products and methods for loading, manipulating, preparing and storing large numbers of tubes or vials. Tube loading systems provided herein also are readily adapted to accommodate automated procedures, including, without limitation, automated insect farming, high volume and high throughput tube labeling systems, biological workstations with auto-feed tube delivery and racking, and the like.

Tube Loading Systems

Provided herein are systems for loading, manipulating, stacking and storing tubes in an array. Systems herein often include tubes, a plate component, and a tray component. As used herein, the term "tube" can be interchanged with the term "vial" or "container" as these types of structures can be utilized in systems herein. The plate and tray functionally engage the tubes, thereby holding the tubes in place, and yielding an array of tubes. The arrays can be configured to any size or shape, such as rectangular or square arrays, for example. In some embodiments a single plate and tray configured to hold a plurality of tubes form a "layer" or "unit". The terms "layer" or "unit" as used herein refers to an arrangement of plates, trays and tubes, where tubes are held between a plate and a tray, a plate and a plate, or a tray and a tray. Plates and trays are independent of each other, and are often used together through a functional or stacking engagement. That is, plates and trays often have no common attachment points and often do not form a hinged, "clam-shell structure", as with egg cartons for example. Thus, there often are no attachments between the plates and trays that form a layer or unit.

Each layer or unit may be used alone, or in stacking engagement with one or more other layers. In some embodiments with an optional second layer of tubes, the optional layer of tubes may be formed between two plates, where the lower plate also acts as the plate in a plate and tray layer. In embodiments with an optional second layer of tubes, the functional attachment (e.g., stacking engagement and/or insertional engagement described below) between units or layers generally is reversible.

The term "array" as used herein refers to an arrangement of tubes or vials across a two-dimensional surface. An array may be of any convenient general shape (e.g., circular, oval, square, rectangular). An array may be referred to as an "X by Y array" for square or rectangular arrays, where the array includes X number of tubes in one dimension and Y number of tubes in a perpendicular dimension. For example, a "2 by 4 array" includes two tubes in one dimension and four tubes in a perpendicular dimension, where the array includes a total of eight (8) tubes. An array may be symmetrical (e.g., a 16 by 16 array) or non-symmetrical (e.g., an 8 by 16 array). An array may include any convenient number of tubes or vials in any suitable arrangement. For example, X or Y independently can be 1, 2, 3, 4, 5, 6, 7, 8, 9, 10, 11, 12, 13, 14, 15, 16, 17, 18, 19, 20, 21, 22, 23, 24, 25, 26, 27, 28, 29 or 30 in some embodiments, and the array can be a 10 by 10 array, for example, in specific embodiments. In some embodiments the term "layer" may also refer to an array of tubes that is one tube "thick," and stated another way, an array of tubes for which the dimension perpendicular to the two-dimensional plane of the array is one tube high and the tubes are held between independently selected plate and/or tray components.

The plate and tray often are "partitionless" in terms of not having a grid or like connected structure to retain tubes. The tubes are held in place by contact with plate and tray projections and the inner surfaces of the plate and or tray components, in some embodiments. There often is no intermediary stabilizing element to prevent the tubes from moving laterally. Intra-layer (i.e., tubes within plate and tray components) and inter-layer (i.e., tube loading system units, nested together by stacking engagement) stability often depends solely on the plate and tray components. As used herein, the term "projection" means a three dimensional protrusion contiguous with a surface from which the projection protrudes. The three dimensional protrusions, or projections, may be any shape desirable, and conical, cubical, and diamond are non-limiting examples of shapes useable in some embodiments. In some embodiments the projections can have any convenient cross section and side surface orientation for effective connection with tubes, and cross sections sometimes are isometric (diagonals and/or sides are equal). Non-limiting examples of cross sections are square, triangular, circular, conical (e.g., rounded or pointed terminus), X-shaped, Y-shaped and the like. Non-limiting examples of side surface geometries comprise vertical surfaces, tapered surfaces (e.g., where the taper is about 1 to about 20 degrees from vertical, and in some embodiments the taper is about 1 degree, 2 degrees, 3 degrees, 4 degrees, 5 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, or about 20 degrees), curved surfaces, flat surfaces and the like, and can include combinations of the foregoing (e.g., projections of a tube tray embodiment have a combination of straight, curved and tapered surfaces).

Tube loading systems may be configured to allow the tubes a small amount of lateral movement within the plate and tray components to facilitate tube engagement, in certain embodiments. This design feature enables the tubes to seat themselves in the tray or plate, when the tubes are loaded. Due to the configuration of the projections in the plate and/or tray components, the majority of tubes loaded will naturally seat themselves as the plate and/or tray projections slide against the tubes as the distance between the tubes and the plate and/or tray base surfaces decreases. That is, as the plate and/or tray components are pressed against the tubes, the projections contact the tubes, and the tubes are guided into position by the sliding engagement of the projections and tubes. The space between tubes and projections decreases as the wider portion of the projections (near the base, opposite the terminus) slides against the tubes, thereby moving the tubes into the center of the "wells" formed by the juxtaposition of projection surfaces and plate and/or tray base. As used herein the term "well" refers to the spaces between adjacent or juxtaposed projections. That is, a well often is a tube seating location in a plate or tray component formed by the juxtaposition of two or more projections and a surface of a plate and/or tray. Any tubes not initially seated in the manner described, may be seated within the plate or tray components when the tray, plate, and tubes are gently shaken or rocked. Therefore, contact of the tubes with the projections of the inner surfaces of the plate or tray components, while being loaded, in conjunction with the allowable lateral movement configured into the plate and/or tray components directs the tubes into the "wells" of the plate or tray components, thereby allowing seating of the tubes within the tube loading system components.

The lateral movement allowable in the configuration of the plate and tray components will depend on the shape of the array, number of tubes in the array, and the size of the tubes being held in the tube loading system array. The allowable lateral movement configured in the plate and tray components may be about 1 millimeter to about 30 millimeters in some embodiments. For example the allowable lateral movement configured in the plate and tray components may be about 1 millimeter, 2 millimeters, 3 millimeters, 4 millimeters, 5 millimeters, 6 millimeters, 7 millimeters, 8 millimeters, 9 millimeters, 10 millimeters, 11 millimeters, 12 millimeters, 13 millimeters, 14 millimeters, 15 millimeters, 16 millimeters, 17 millimeters, 18 millimeters, 19 millimeters, 20 millimeters, 21 millimeters, 22 millimeters, 23 millimeters, 24 millimeters, 25 millimeters, 26 millimeters, 27 millimeters, 28 millimeters, 29 millimeters, and about 30 millimeters in certain embodiments.

Tube loading system embodiments described herein can be configured to function in fully automated, semi automated or manual tube loading applications. Components of tube loading systems can be used as racks or trays in other automated or high throughput systems, where multiple tubes or vials are handled or processed simultaneously, making seamless the transition from preparing tubes and vials to performing procedures, experiment or analysis. Additionally, tube-loading systems are configured for use with lifting and loading systems such as clamps or miniature fork lift-like mechanisms (e.g., in robotic biological work stations), thus allowing ready manipulation of the entire tube arrays.

Tubes

In some embodiments the tube loading system may be configured for use with any commonly sized commercially available tube, container or vial. Tube loading systems may be configured to accommodate custom or non-standard sized tubes, in certain embodiments. As used herein the term "tube" is defined as any suitable container that holds a liquid or medium. A tube may be configured with any cross-sectional shape desirable and square or circular are two non-limiting examples of cross section shapes. In certain embodiments a tube may have a top, a bottom and at least one side. A tube may have a sidewall with an inner and outer surface in some embodiments. The inner sidewall surface of a tube often is a contiguous surface or may be formed from adjoining surfaces that form a leak-proof seal when joined. A tube "bottom" may be a curved surface or a flat surface, in some embodiments. As used herein, the term "tube bottom" refers to the non-open end of a tube, on which the tube may stand upright. The cross section of a tube bottom often is substantially similar to the cross section of the mid-point or top of the tube. In some embodiments a tube may have an opening, and the opening sometimes has a closure in some embodiments. In some embodiments a tube closure can be, without limitation, a screw cap top, or a lid that that snaps securely in place to the body of tube to provide a leak resistant or leak proof seal, for example. As used herein, the term "tube top" refers to the open end of a tube, through which a tube may be loaded or filled. In some embodiments the tubes may have a tapered body. In certain embodiments the tubes may have a non-tapered body. Therefore, a container, vial or tube with a cap or lid can be accommodated in tube loading systems described herein. The term "tube" as used herein refers to a tube, container, vial and the like.

Tube loading system designs allow a universal fit plate and tray that can accommodate manufacturer differences for tubes. That is, for a given tube volumetric capacity, a particular plate and tray configuration may accommodate tubes of varying diameters. In some non-limiting embodiments a tube loading system may be configured to hold tubes with a cross-section width or diameter measuring about 5 millimeters (mm), about 8 millimeters, about 10 millimeters, about 12 millimeters, about 15 millimeters, about 17 millimeters, about 20 millimeters, about 23 millimeters, about 25 millimeters, about 27 millimeters, 30 millimeters, about 35 millimeters, about 40 millimeters, about 45 millimeters, and about 50 millimeters in diameter or width. Non-limiting examples of tube capacities are about 15 milliliters (ml), about 20 milliliters, about 50 milliliters, about 100 milliliters, about 125 milliliters (about 4 ounces), about 150 milliliters (about 5 ounces), about 175 milliliters (about 6 ounces), about 200 milliliters (about 7 ounces), about 225 milliliters (about 8 ounces), and about 250 milliliters (about 9 ounces).

In some embodiments tubes are manufactured from a variety of materials. Common materials used for the manufacture of these types of tubes are glass, polypropylene, polyethylene, and polycarbonate. Other thermoplastics or polymers also may be used. Many commercially available tubes come pre-sterilized or with guarantees of being RNase, DNase, and protease free. For the purpose of these embodiments, any material that has good chemical or solvent resistance has low liquid retention (i.e., made of hydrophobic materials or coated with a hydrophobic material), is safe for the handling of biological materials (RNase, DNase, and protease free), and that can withstand heating and extreme cooling is suitable for use.

Plate Components

In some embodiments a tube loading system provides a plate that can orient tubes in an array, comprising a base having an inner surface and an outer surface, a first set of projections extending from the inner surface, and a second set of projections extending from the outer surface. A plate also can be referred to as an orientation and stacking plate (OSP) or an orientation and stacking insert (OSI).

Illustrated in FIGS. 1A-1D is a plate 10 component embodiment of a tube loading system of the current invention. Plate 10 comprises, in part, plate base 12 (FIGS. 1B and 1C), which has inner surface 14 (FIGS. 1A and 1B) and outer surface 16 (FIGS. 1A and 1B) as defined by sidewall 22. Plate base 12 can be made in a variety of sizes and configured to hold a plurality of tubes. The number of tubes that may be held in plate base 12 will be dependent on the dimensions of the plate base and the size of the tubes the plate component is configured to hold. In some embodiments plate base 12 may be substantially rectangular. In some embodiments the length of each pair of parallel sides of the rectangular plate base may be about 10 centimeters to about 50 centimeters, for example. In some embodiments plate base 12 may be substantially square. In the embodiment illustrated in FIGS. 1A-1D, plate 10 has a substantially square plate base 12 configured to hold 100 tubes, where the length of a side of the base is about 19 centimeters to about 37 centimeters (e.g., 20 centimeters, 21 centimeters, 22 centimeters, 23 centimeters, 24 centimeters, 25 centimeters, 26 centimeters, 27 centimeters, 28 centimeters, 29 centimeters, 30 centimeters, 31 centimeters, 32 centimeters, 33 centimeters, 34 centimeters, 35 centimeters, and about 36 centimeters in length) in certain embodiments.

Plate base 12 has inner surface 14 and outer surface 16. Inner surface 14 of plate base 12 is defined, in part, by a perimeter around plate base 12 created by sidewall 22 of plate 10. The shape and dimensions of inner surface 14 and outer surface 16 are substantially similar to the shape and dimensions of plate base 12. In some embodiments portions of Inner surface 14, specifically axial edges 30 and curved surfaces 28 of inner surface projection 18, are in effective contact with the tops of tubes in the array.

In some embodiments inner surface 14 and outer surface 16 of plate base 12 may have projections. In certain embodiments inner surface 14 may have inner surface projections 18

(e.g. a first set of projections), as illustrated in FIGS. 1A-1D. In some embodiments, outer surface 16 may have outer surface projection 20 (e.g. a second set of projections), as illustrated in FIGS. 1A-1D. In some embodiments the first set of projections and the second set of projections of the plate extend and terminate in opposite directions.

Figure 1B:
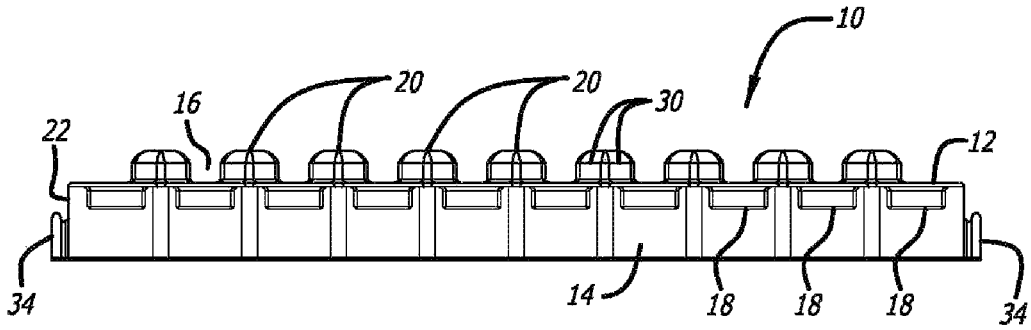
FIG. 1B is a side elevation drawing of a tube holding system plate of the present invention.

In some embodiments inner surface projections 18 of plate 10 are cubical in shape (i.e., having a three dimensional cube appearance), with a square cross-section. Projections within the first set of projections are isolated from other projections in first set, in certain embodiments. That is, in some embodiments the inner surface projections 18 are isolated from one another. In certain embodiments outer surface projections 20 are diamond shaped with a flat top and a diamond shaped cross-section. In some embodiments, projections within the second set of projections are isolated from other projections in second set. That is, the outer surface projections 20 sometimes are isolated from one another. As used herein, the term "isolated" means that no surface of one projection is in contact with, integrated with, or intersects with a surface of another projection in a given set of projections; as projections of two different sets extend from different surfaces of the base, projections of one set are isolated from projections of another set. In some embodiments, projections 18, 20 of plate component 10 comprise 3 or more axial edges 30, as illustrated in FIGS. 1B and 10. In some embodiments, projections 18, 20 comprise 4 axial edges 30. In certain embodiments the surfaces between edges 30 are curved 28, 32. In some embodiments with curved surfaces, the surfaces are concave. In certain embodiments the radius of curvature of the curved surfaces is in the range of about 5 millimeters to about 40 millimeters (e.g., about 5 millimeters, about 6 millimeters, 7 millimeters, 8 millimeters, 9 millimeters, 10 millimeters, 11 millimeters, 12 millimeters, 13 millimeters, 14 millimeters, 15 millimeters, 17 millimeters, 18 millimeters, 19 millimeters, 20 millimeters, 25 millimeters, 30 millimeters, 35 millimeters, or about 40 millimeters in radius). As used herein, the term "radius of curvature" refers to a distance represented by a line drawn from the midpoint of a curve or circle to a point on the circumference of that curve or circle. This distance represents the radius or one-half the diameter of the curve or circle. A curve generated through all possible points, as determined by the radius length, defines both the arc curvature and the radius distance of the curvature. For ease of explanation, the radius length will be used herein to define the radius of curvature.

In some embodiments the height of inner surface projections 18 and outer surface projections 20, above the surface of plate base 12, may be about 2 millimeters to about 20 millimeters (e.g., about 5 millimeters to about 15 millimeters; about 8 millimeters to about 12 millimeters) in height above the surface of plate base 12. The height of the projections can affect overall stability of the tube loading system layer or unit. The higher the projections protrude from the respective surfaces of plate base 12, the greater the surface area of the projection put into effective communication with the corresponding "recipient", the top or inner surface of tubes or the inner surface of projection 48 of tray component 40 for example, thereby additionally stabilizing the respective components through insertional engagement. In some embodiments, the projections can be about 2 millimeters to about 20 millimeters (e.g., about 5 millimeters to about 15 millimeters; about 8 millimeters to about 12 millimeters) in height above the surface of plate base 12.

In some embodiments inner surface projections 18 of plate 10 may be in effective communication with the inner surface or top of each tube in the array through curved surface 28 of inner projection 18. In some embodiments inner surface projections 18 may sit within the opening of tubes, thereby increasing lateral stability by decreasing lateral movement by being in effective communication with the top and inner surface of the tubes. In some embodiments inner surface projections 18 may enable self-alignment and therefore seating of plate 10, by interaction of tubes with plate 10, inner surface projections 18, inner surface 14 and in some instances sidewall 22 (i.e., when the tube or tubes in question are on the perimeter of the array). Self-alignment may occur when a portion of plate 10 is placed in effective communication with a row of tubes held in tube loading system tray component 40, illustrated in FIGS. 2A-2F. Placing plate 10 in effective communication with a row of tubes held in tray component 40, and more specifically on the perimeter of tray component 40, allows the inner surface 14 and inner surface projections 18 to interact with the top and inner surface of the tubes, which brings inner surface projections 18 into alignment with substantially the rest of the tubes in tray 40. Movement of plate 10 and tubes held in tray 40 (FIGS. 2A-2D) may cause lateral movement of other tubes in the array as well as the plate, further placing the tubes into favorable alignment for seating of plate 10. In some embodiments, gentle rocking or shaking optionally may be applied to tube loading systems, to further facilitate engagement of the tubes, inner surface 14 and inner surface projections 18, of plate 10.

In certain embodiments outer surface projections 20 of plate 10 may be in effective communication with the bottoms of two or more tubes in an optional second layer of tubes in stacked connection with the outer surface of the plate. That is tubes may be held between two plates, as opposed to a plate and tray. The optional second layer of tubes may be held in place by stacked connection between outer surface 16 and outer surface projections 20 of a plate and the inner surface 14 and inner surface projections 18 of another plate in contact with the open tops of tubes. As used herein "stacked connection," means layers of tubes that are vertically stacked with respect to one another.

In some embodiments, the axial centerlines of tubes in one layer are offset from the axial centerline of tubes in another layer. Due to the nature of the outer or top surface of plate 10 (i.e., no perimeter sidewall), the optional second layer of tubes in stacked connection often has fewer tubes.

In some optional embodiments outer surface projections 20 of plate 10 may be in effective communication with the inner surface of tray projections 48. That is, outer surface projections 20 of plate 10 may insertionally engage the inner surface of tray projections 48 (i.e., the depressions in the underside (outer surface 46) of the tray component 40). The inner surfaces of tray projections 48 are contiguous with the outer surface of tray base 42. The insertional engagement occurs when the axial edges 30 and curved surfaces between axial edges 32 of outer surface projection 20 of plate 10 frictionally engage the inner surface of projection 48 of tray 40, when a plate component 10 of one layer or unit is optionally placed in stacking connection with the tray component of another layer or unit. The insertional engagement of outer surface projections 20 and the inner surface of tray projections 48 enables the stacking functionality (interlocking), of the tube loading systems by allowing the plate of one layer or unit to be interlocked with the tray of another layer or unit. The interlocking or insertional engagement may confer additional stability to the nested stacking functionality of the tube loading system.

Plate base 12 has sidewall 22, which extends from, and helps define inner surface 14 by creating a perimeter around plate base 12, thereby functionally defining the inner 14 and outer 16 surfaces of plate base 12. In some embodiments sidewall 22 may have a height of about 10 millimeters to about 40 millimeters (e.g., about 15 millimeters to about 35 millimeters, about 20 to about 30 millimeters), as illustrated in FIGS. 1A-1D. The height of the sidewall 22 of plate 10 sometimes is one-fifth (⅕) to one-half (½) the height of the tube that can be held therein. Sidewall 22 of plate base 12 is in effective contact with tubes located on the perimeter of the array. In some embodiments the sidewall may have curved portions 26. The curved portions 26 of sidewall 22 further enhance the contact between the tube and the sidewall 22 due to the ability of the curved portion 26 of the sidewall 22 to cradle the tube, as opposed to a tangential contact between curved and flat surfaces, as is the case with a non-curved sidewall, for example. In some embodiments the radius of curvature of the curved portion 26 of the sidewall 22 is in the range of about 5 millimeters to about 40 millimeters (e.g., about 5 millimeters, about 6 millimeters, 7 millimeters, 8 millimeters, 9 millimeters, 10 millimeters, 11 millimeters, 12 millimeters, 13 millimeters, 14 millimeters, 15 millimeters, 17 millimeters, 18 millimeters, 19 millimeters, 20 millimeters, 25 millimeters, 30 millimeters, 35 millimeters, or about 40 millimeters in radius). In certain embodiments, for use with circular cross-section tubes, curved portions 26 of plate 10 (e.g., sidewall) often have a slightly larger radius of curvature than the radius of curvature of the tubes to accommodate, and fit around, tubes in the array.

In some embodiments, sidewall 22 may have a sidewall flange 24. Sidewall flange 24 extends outward perpendicularly or horizontally from sidewall 22. In some embodiments the flange may be located at the sidewall 22 terminus, opposite the plate base 12. In some embodiments the width of sidewall flange 24 may be about 1 millimeter to about 10 millimeters (e.g., about 2 millimeters to 9 millimeters). In certain embodiments, sidewall 22 may have optional sidewall tab 34. Sidewall tab 34 may optionally be included in manufacture of plate 10 to connect or lock units together. This feature may prove useful to allow like treated tubes to be kept together in automated machinery, or to allow additional stability during stacking or nested storage, for example. Optional sidewall tabs 34 may be configured in any desirable shape or size, depending on the required use. As illustrated in FIGS. 1A-1C, optional sidewall tabs 34 are semi-circular in shape. Optional sidewall tabs 34 of one plate can be seated over or fit onto optional sidewall tabs of another plate, thereby locking or connected the units together in an end-to-end manner.

In some embodiments plate 10 comprises a plastic. In certain embodiments plate 10 comprises a cellulosic material. As used herein, the term "cellulosic material" refers to any material substantially derived from wood or paper, wood pulp, paper pulp or recycled paper pulp for example. Plate 10 also may comprise a metal in certain embodiments. In some embodiments the thickness of the plastic, cellulosic material or metal used to form plate 10 may be in the range of about 0.2 millimeters to about 15 millimeters. For example, plate 10 may be formed from plastic that is about 0.2 millimeters, 0.3 millimeters, 0.4 millimeters, 0.5 millimeters, 0.6 millimeters, 0.7 millimeters, 0.8 millimeters, 0.9 millimeters, 1.0 millimeters, 1.1 millimeters, 1.2 millimeters, 1.3 millimeters, 1.4 millimeters, and about 1.5 millimeters in thickness, for example. In some embodiments plate 10 may be formed from cellulosic material that is about 1 millimeter, 2 millimeters, 3 millimeters, 4 millimeters, 5 millimeters, 6 millimeters, 7 millimeters, 8 millimeters, 9 millimeters, 10 millimeters, 11 millimeters, 12 millimeters, 13 millimeters, 14 millimeters, or 15 millimeters in thickness. Plate 10 also may be formed from metal that is about 0.2 millimeters, 0.3 millimeters, 0.4 millimeters, 0.5 millimeters, 0.6 millimeters, 0.7 millimeters, 0.8 millimeters, 0.9 millimeters, 1.0 millimeters, 1.1 millimeters, 1.2 millimeters, 1.3 millimeters, 1.4 millimeters, 1.5 millimeters, 2.0 millimeters, 2.5 millimeters, 3.0 millimeters, 3.5 millimeters, 4.0 millimeters, 4.5 millimeters, or about 5 millimeters in thickness, for example.

In some embodiments a tube loading system layer or unit (tubes, a plate component 10 and a tray component 40) may be stacked or nested with (on top of, or below) other tube loading system layers or units, by insertional engagement of plate 10 outer surface projections 20 and the inner surface of tray 40 projections 48. In certain embodiments the plates (and therefore trays and layers or units) may be stacked at least two layers high, 2 or more layers high, 5 or more layers high, 10 or more layers high, 15 or more layers high, 20 or more layers high, and 25 or more layers high. In some embodiments with stacked layers, the axial centerlines of tubes in one layer are coaxially aligned with centerlines of tubes in another stacked layer.

Tray Components

In some embodiments a tube loading system provides a tray that can orient a layer of tubes in an array which comprises, a tray base having an inner surface and an outer surface, and a first set of tray projections extending from the inner surface of the base, each of the projections is in effective contact with the bottom of two or more tubes, and the projections position the tubes in an array. A tray also can be referred to as a "rack".

Illustrated in FIGS. 2A-2F is a tray 40 component embodiment of a tube loading system. Illustrated in FIGS. 3A-3D is an alternative tray 40' component embodiment of a tube loading system. Trays 40 and 40' comprise, in part, tray base 42 (FIGS. 2C, 2E, 2F, and 3B), which has inner surface 44 (FIGS. 2A, 2F and 3B) and outer surface 46 (FIGS. 2B, 2E, 2F, 3C and 3D) as defined by sidewall 54 (FIGS. 2A-2E and 3A-3D). Like the plate base, tray base 42 can be made in a variety of sizes and configured to hold a plurality of tubes, dependent, in part, on the dimensions of the tray base and the size of the tubes the tray components are configured to hold. Tray components 40 and 40' sometimes are configured to be substantially the same shape and size as the corresponding plate component. In some embodiments tray base 42 is substantially rectangular. In some embodiments the length of each pair of parallel sides of the rectangular tray base may be about 10 centimeters to about 50 centimeters. In some embodiments tray base 42 is substantially square. In the embodiments illustrated in FIGS. 2A-2F and 3A-3D, trays 40 and 40' have a substantially square tray base 42, configured to correspond to plate component 10 and also configured to hold 100 tubes, where the length of a side of the base sometimes is about 25 centimeters to about 28 centimeters. Tray bases may have a side length of about 19 centimeters to about 40 centimeters (e.g., about 20 centimeters, 21 centimeters, 22 centimeters, 23 centimeters, 24 centimeters, 25 centimeters, 26 centimeters, 27 centimeters, 28 centimeters, 29 centimeters, 30 centimeters, 31 centimeters, 32 centimeters, 33 centimeters, 34 centimeters, 35 centimeters, 36 centimeters, 37 centimeters, 38 centimeters, 39 centimeters, and about 40 centimeters in length). In some embodiments, trays 40 and 40' may be in contact with the top layer of tubes. In certain embodiments one or more trays 40, 40' can be between one or more layers of tubes.

Figure 2A:
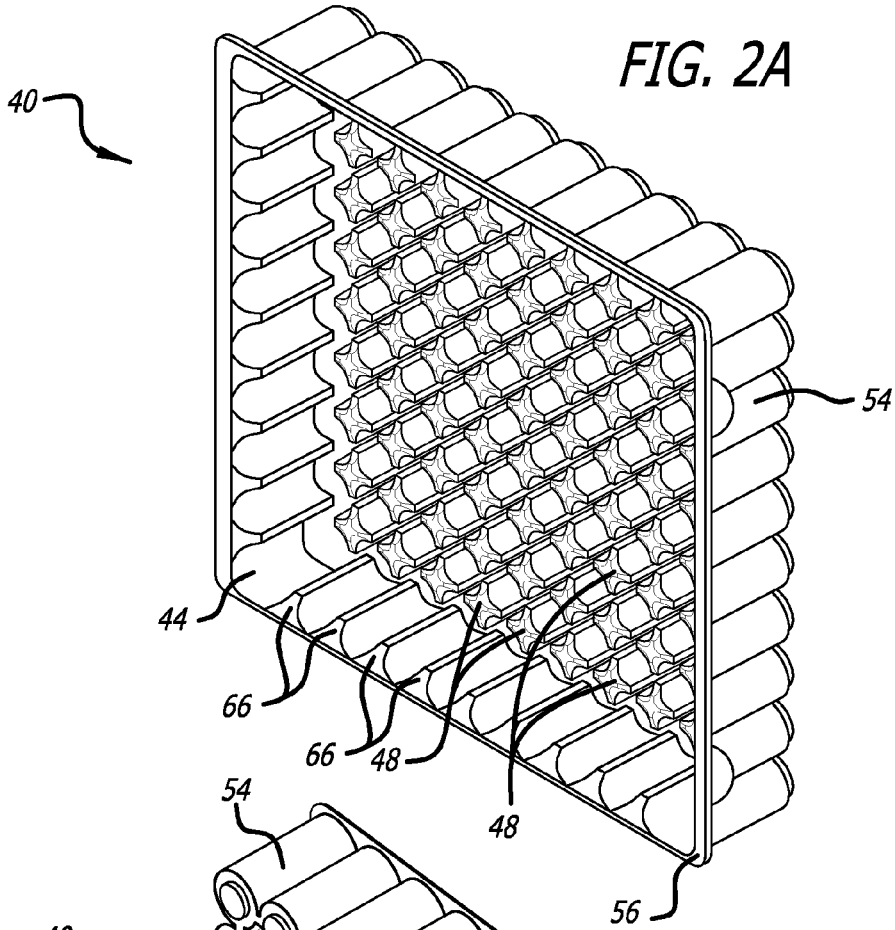
FIG. 2A is a top or inner surface perspective drawing of a tube holding system tray of the present invention.
Figure 2B:
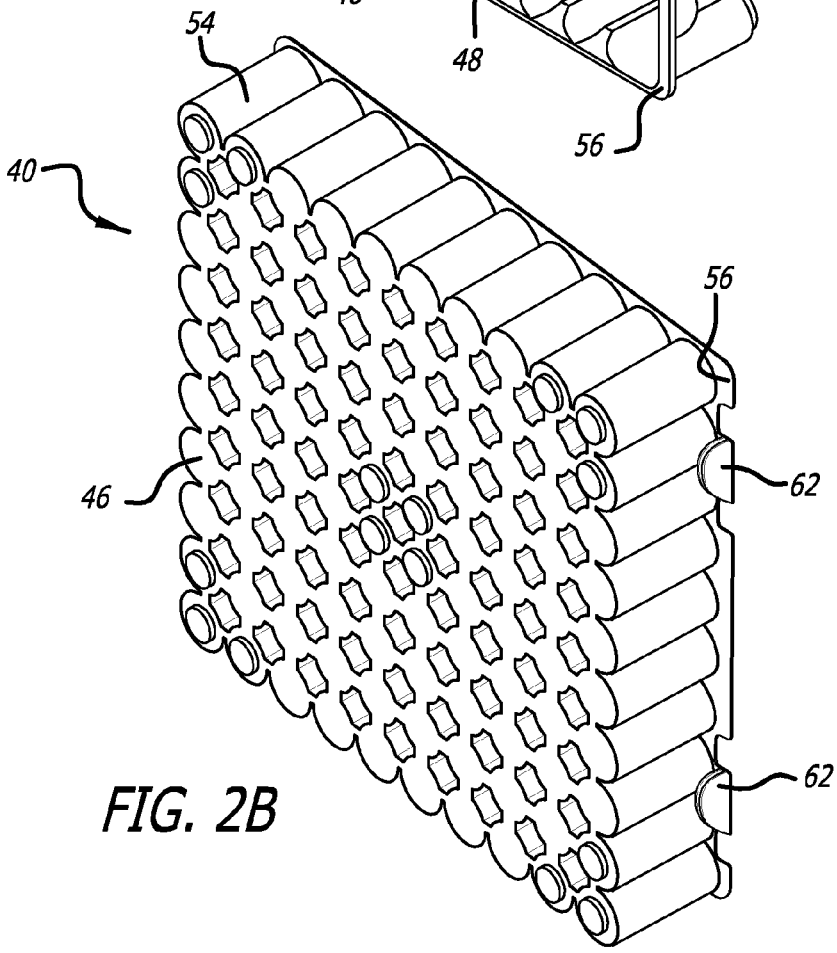
FIG. 2B is a bottom or outer surface perspective drawing of a tube holding system tray of the present invention.
Figure 3A:
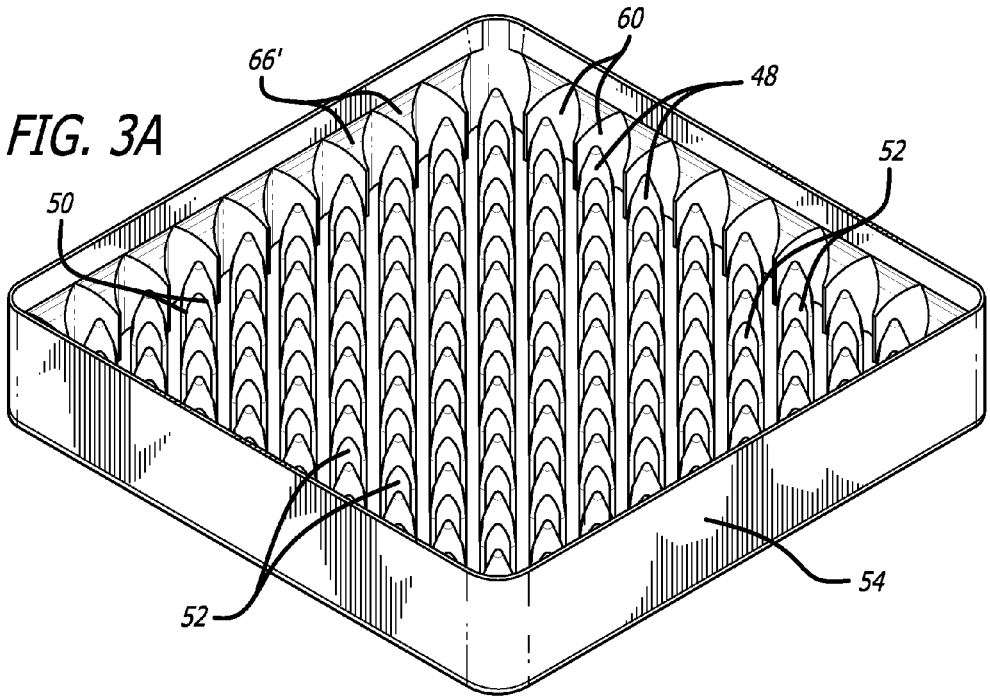
FIG. 3A is a top perspective drawing of an alternative tube holding system tray of the present invention.
Figure 3B:
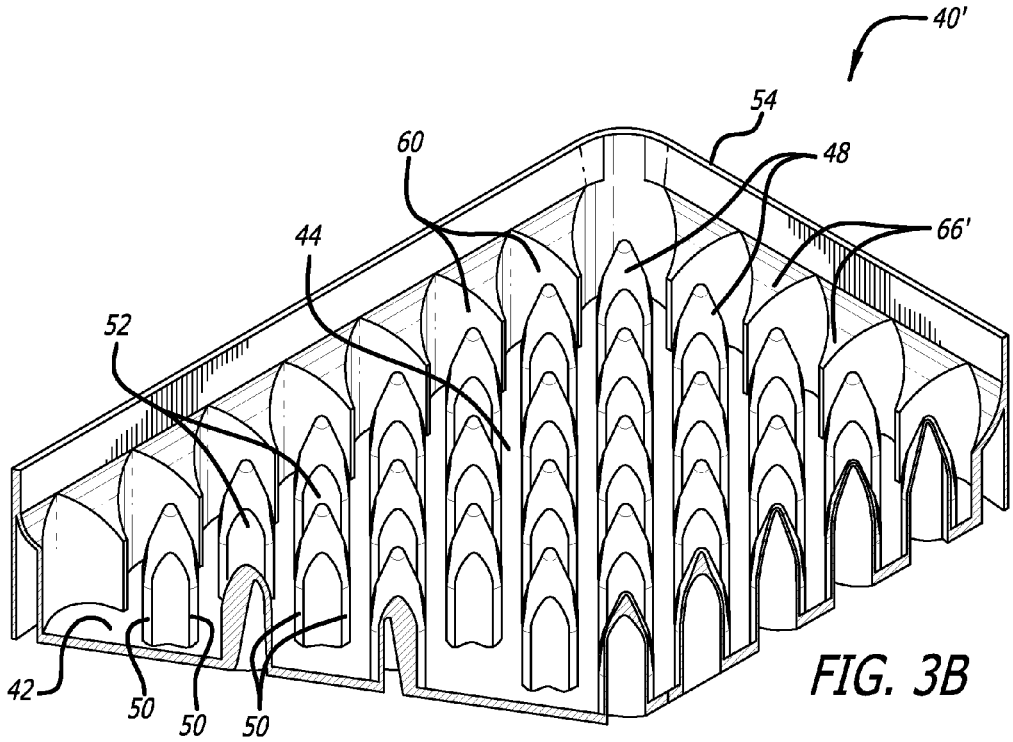
FIG. 3B is a cut away perspective view of an alternative tube holding system tray of the present invention.
Figure 3C:
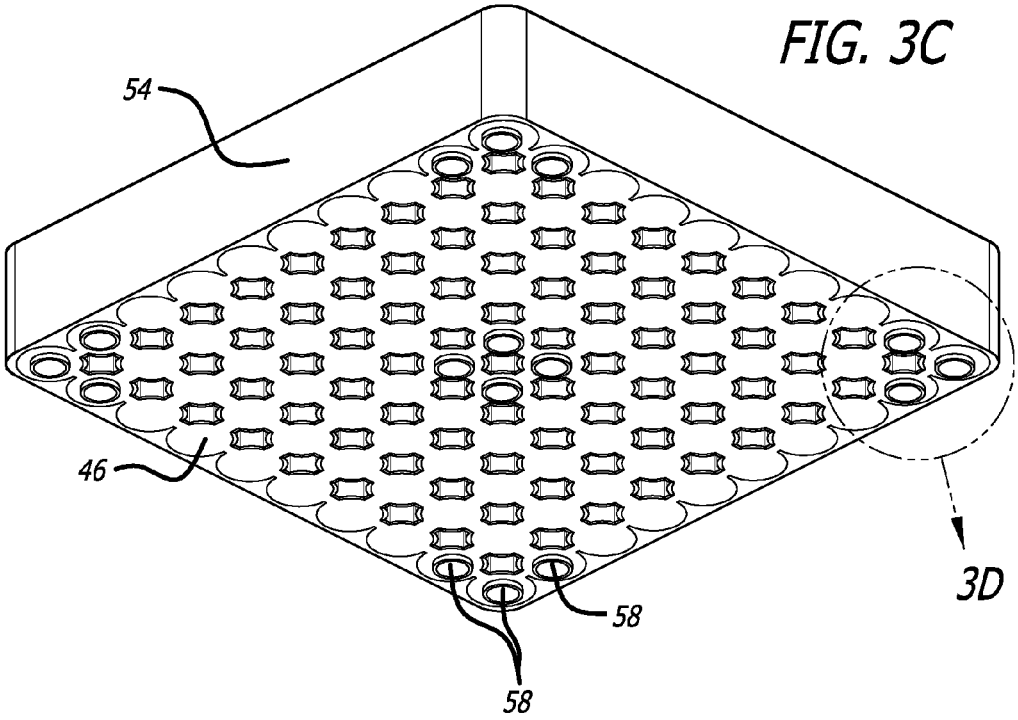
FIG. 3C is a bottom perspective illustration of an alternative tube holding system tray of the present invention.
Figure 3D:
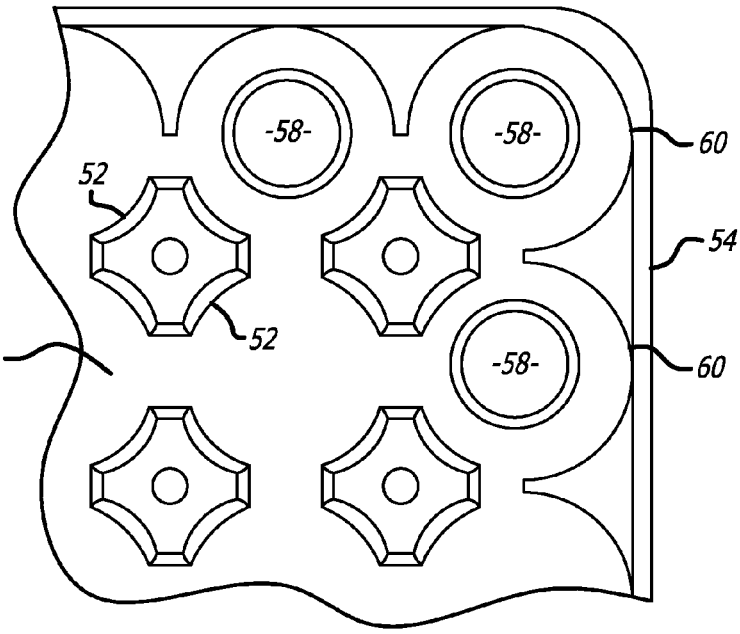
FIG. 3D is an enlarged detail view of the circled area in FIG. 3C.
Figure 4A:
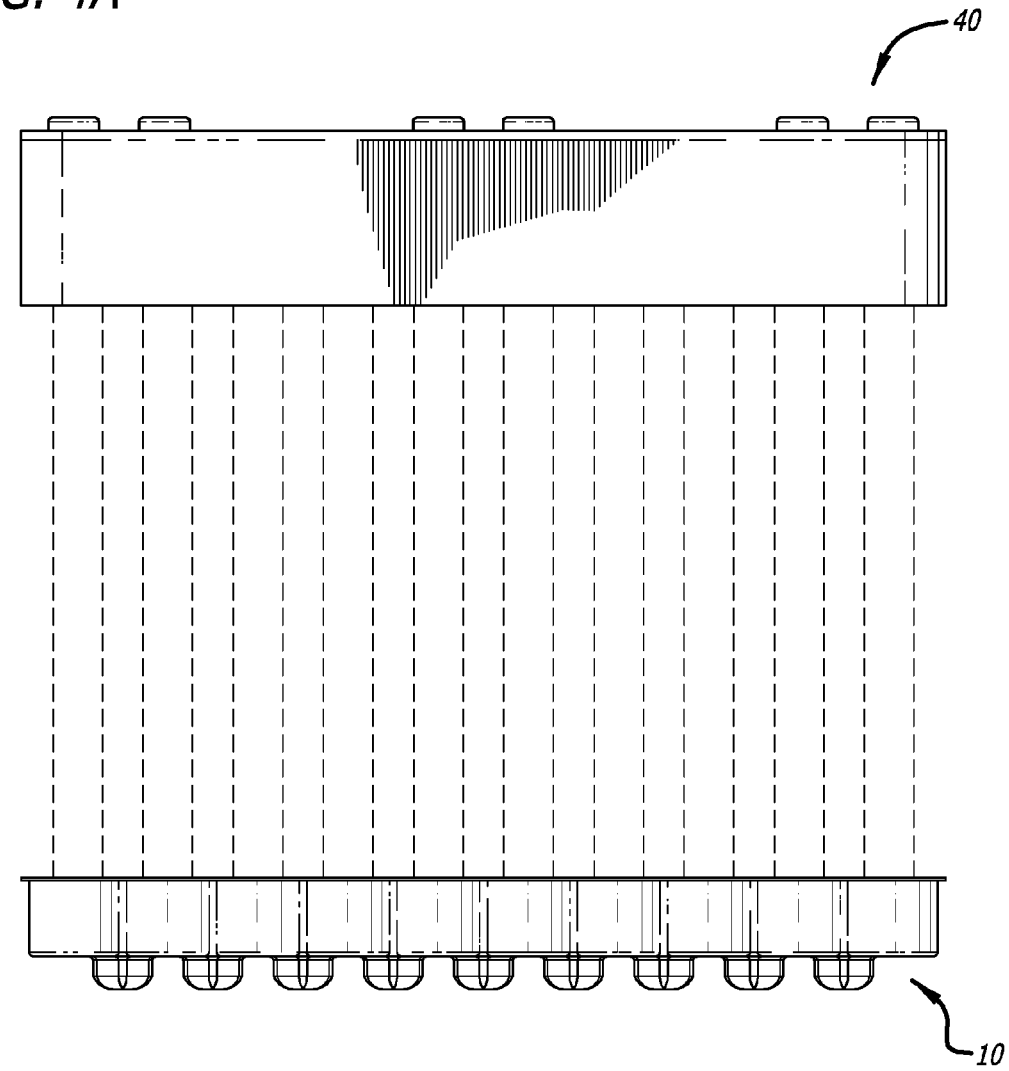
FIGS. 4A and 4B are side elevation views of a tube reload system comprising a plate, a tray and tubes. The plate, tray and tubes when in effective connection with each other comprise a layer of tubes. Tube reload systems described herein can be configured with tubes, as illustrated in FIG. 4A, or without tubes, as illustrated in FIG. 4B. A tube layer often comprises two or more tubes.
Figure 4B:
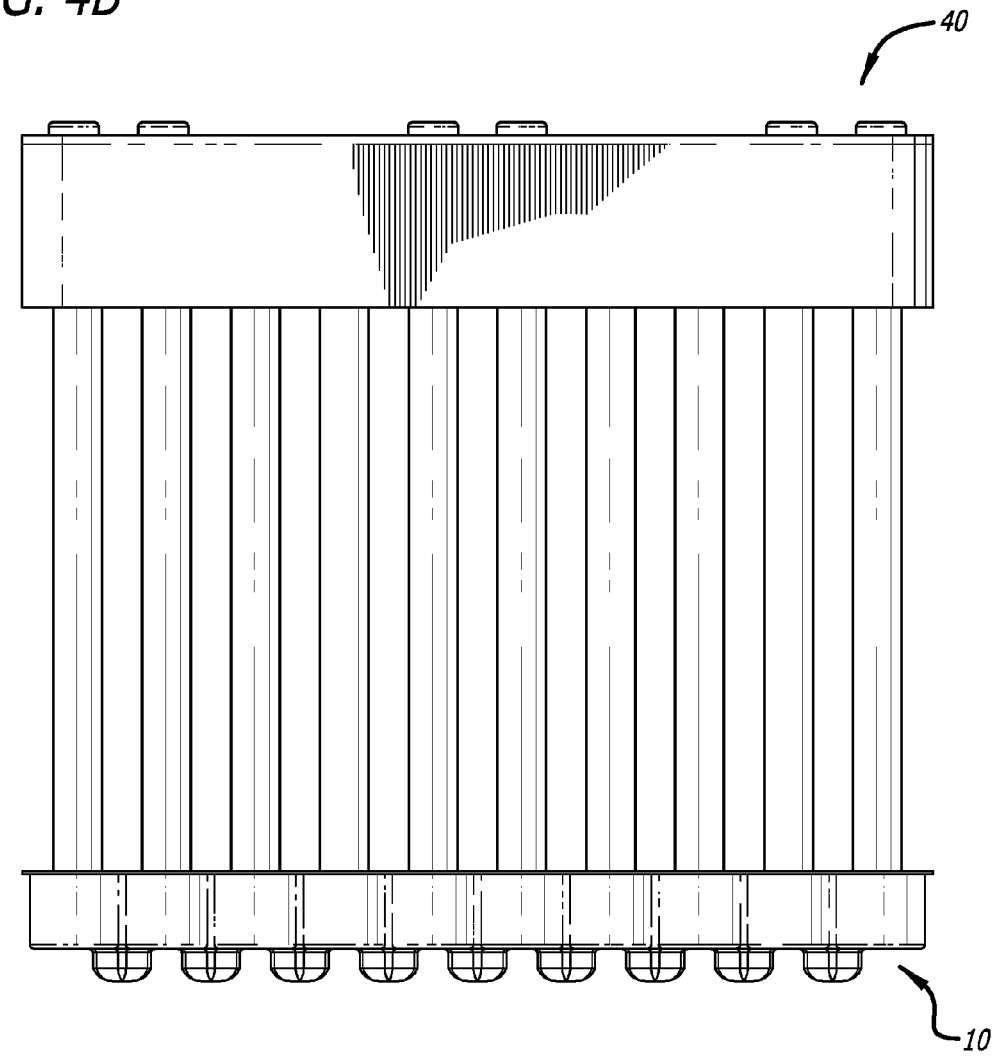

Tray base 42 has inner surface 44 and outer surface 46. Inner surface 44 of tray base 42 is defined, in part, by a perimeter around tray base 42 created by sidewall 54 of trays 40 and 40'. The shape and dimensions of inner surface 44 and outer surface 46 are substantially similar to the shape and dimensions of tray base 42. In some embodiments portions of inner surface 44, specifically axial edges 50 and curved surfaces between axial edges 52 of tray projection 48, are in effective contact with the bottoms of tubes in the array. In some embodiments, the outer surface of sidewall 54 is curved, as illustrated in FIGS. 2A-2C. In some embodiments, the outer surface of sidewall 54 is flat (e.g., has no visible curves), as illustrated in FIGS. 3A, 3C and 3D.

In some embodiments inner surface 44 and outer surface 46 of tray base 42 may have projections. In certain embodiments inner surface 44 may have inner surface projections 48 (e.g. a first set of projections), as illustrated in FIGS. 2A, 2F, 3A and 3B. In some embodiments, outer surface 46 may have outer surface projection 58 (e.g. a second set of projections), as illustrated in FIGS. 2E, 2F, 3C and 3D. In some embodiments the first set of projections and the second set of projections of the plate extend and terminate in opposite directions. Like the plate projections, tray projections 48 and 58 can have any convenient cross section and side surface orientation described for plate projections. In some embodiments inner surface projections 48 have a shape and cross-section configured to accommodate effective connection with tubes. In certain embodiments the outer surface projections have a shape and cross-section that accommodates a tray spacing and "foot" function. As used herein, the term "foot" generally means to provide support for, or a base on which to stand.

In some embodiments the inner surface tray projections in the first set of tray projections comprise one or more surfaces and a terminus opposite the tray base. In certain embodiments the surfaces taper as they extend from the tray base to the terminus. In some embodiments inner surface projections 48 of plate 40 are conical in shape. In some embodiments with conical surface projections, the cross-section of surface projections may be diamond shaped. In certain embodiments projections within the first set of projections are isolated from other projections in first set. That is, in some embodiments the inner surface projections 48 are isolated from one another. In certain embodiments outer surface projections 58 are round shaped with a flat top and a circular cross-section. In some embodiments, projections within the second set of projections are isolated from other projections in second set. That is, in some embodiments the outer surface projections 58 are isolated from one another. In some embodiments, projections 48 of tray components 40 and 40' comprise 3 or more axial edges 50, as illustrated in FIGS. 2F, 3A and 3B. In some embodiments, projections 48 comprise 4 axial edges 50. In certain embodiments, the surfaces between edges 50 are curved 52 (FIGS. 2D, 3A, 3B and 3D). In some embodiments with curved surfaces 52, the surfaces are concave. In certain embodiments the radius of curvature of the curved surfaces is in the range of about 5 millimeters to about 40 millimeters (e.g., about 5 millimeters, about 6 millimeters, 7 millimeters, 8 millimeters, 9 millimeters, 10 millimeters, 11 millimeters, 12 millimeters, 13 millimeters, 14 millimeters, 15 millimeters, 17 millimeters, 18 millimeters, 19 millimeters, 20 millimeters, 25 millimeters, 30 millimeters, 35 millimeters, or about 40 millimeters in radius).

In some embodiments inner surface projections 48 of tray 42 enable rapid loading of tubes into tray 42 through interaction of curved surfaces 52 and axial edges 50 of tray projection 48 with the outer surfaces of tubes being loaded into tray 42. The tubes often are fed into the tray by automated or manual means, for instance an automated tube shoot or delivery system, temporarily placed in effective communication with the tray components 40 or 40', or by manually pouring tubes into the tray from a source of tubes. Due to the configuration of the projections in tray component 42, the majority of tubes loaded will naturally seat themselves as described previously. As the tubes are positioned by the action of the plate and tray projections, the tube bottoms make contact with projections 48 of tray 42. The projections are conical and tapered at the terminus opposite the base, and therefore allow a sliding engagement of the tube and projection, which allows the tube to slide into the "well" created by the juxtaposition of surrounding regularly spaced projections.

Each tube in the array can be contacted by at least two inner surface projections 48, through interaction of the tube outer surface and the curved surfaces 52 between axial edges 50 of projection 48. Tubes not on the perimeter of the array can be contacted by four inner surface projections 48. Two tubes, adjacent to each other in the array and not on the perimeter of the array can be contacted by six inner surface projections, with the central two inner surface projections being shared between the adjacent tubes. The curved surfaces 52 between the axial edges 50 are designed to accommodate the radius of curvature of the tubes, thereby creating the additional stability associated with curved surfaces cradling curved surfaces, as opposed to a tangential contact between flat surfaces and curved surfaces. Any tubes not initially seated as discussed above, may be seated within the tray component when the tray and tubes are gently shaken or rocked, thereby allowing the tubes to be seated within the tube loading system components.

In some embodiments the height of inner surface projections 48 above the inner surface 44 of tray base 42, may be about 10 millimeters to about 45 millimeters. For example, inner surface projections 48 may have a height above the inner surface of tray base 42 of about 10 millimeters, 11 millimeters, 12 millimeters, 13 millimeters, 14 millimeters, 15 millimeters, 16 millimeters, 17 millimeters, 18 millimeters, 19 millimeters, 20 millimeters, 21 millimeters, 22 millimeters, 23 millimeters, 24 millimeters, 25 millimeters, 26 millimeters, 27 millimeters, 28 millimeters, 29 millimeters, 30 millimeters, 31 millimeters, 32 millimeters, 33 millimeters, 34 millimeters, 35 millimeters, 36 millimeters, 37 millimeters, 38 millimeters, 39 millimeters, 40 millimeters, 41 millimeters, 42 millimeters, 43 millimeters, 44 millimeters and about 45 millimeters in height above the inner surface 44 of tray base 42, in certain embodiments. In some embodiments the height of outer surface projections 58 below the outer surface of tray base 42, may be about 1 millimeter to about 5 millimeters. For example, outer surface projections 58 may have a height below the outer surface of tray base 42 of about 1 millimeter, 2 millimeters, 3 millimeters, 4 millimeters, and about 5 millimeters in height below tray base 42. As with the plate projections, the height of the inner surface tray projections 48 contributes to the overall stability of the tube loading system layer or unit.

In certain embodiments the height of the tray projection 48 allows substantially complete insertion of the plate outer surface projection 20. Substantially complete insertion into tray projection 48 allows frictional engagement of the respective surfaces. Illustrated in FIGS. 2D and 3D (e.g., the diamond shaped object in FIG. 3D), is a view of the inner surface of tray projection 48 as seen by looking into the projection from the bottom. In some embodiments the inner surface of tray projection 48 has texturing to enhance frictional engagement between the outer surface projection of plate 10 and the inner surface of tray projection 48.

Tray base 42 has sidewall 54, which extends from, and defines, in part, inner surface 44 by creating a perimeter around tray base 42, thereby functionally defining the inner 44 and outer 46 surfaces of tray base 42. In some embodiments sidewall 54 may have a height of about 3 centimeters, 3.5 centimeters, 4 centimeters, 4.5 centimeters, 5 centimeters, 5.5 centimeters, 6 centimeters, 6.5 centimeters, 7 centimeters 7.5 centimeters, 8 centimeters, 8.5 centimeters, 9 centimeters, 9.5 centimeters or about 10 centimeters. In general, the height of sidewall 54 of trays 40 and 40' sometimes is one-third (⅓) to two-thirds (⅔) the height of the tube held therein.

Sidewall 54 of tray base 42 is in effective contact with tubes located on the perimeter of the array. In some embodiments the sidewall may have curved portions 60. The curved portions 60 of sidewall 54 further enhance the contact between the tube and the sidewall 54, as described above and for the curved portions of plate sidewall. In some embodiments the radius of curvature of the curved portion 60 of the sidewall 54 is in the range of about 5 millimeters to about 40 millimeters (e.g., about 5 millimeters, about 6 millimeters, 7 millimeters, 8 millimeters, 9 millimeters, 10 millimeters, 11 millimeters, 12 millimeters, 13 millimeters, 14 millimeters, 15 millimeters, 17 millimeters, 18 millimeters, 19 millimeters, 20 millimeters, 25 millimeters, 30 millimeters, 35 millimeters, or about 40 millimeters in radius). In certain embodiments, for use with circular cross-section tubes, curved portions 60 of trays 40 and 40' (e.g., sidewall) often have a slightly larger radius of curvature than the radius of curvature of the tubes to accommodate, and fit around, tubes in the array.

In some embodiments, sidewall 54 may have inner sidewall protrusions 66 and 66' as illustrated in FIGS. 2A, 3A and 3B. Sidewall protrusions 66 and 66' help define and separate the curved portions 60 of sidewall 54. In some embodiments, sidewall protrusions 66 can be substantially the same height as sidewall 54, and exhibit minimal tapering at the top of the protrusion, as illustrated in FIG. 2A. In some embodiments, sidewall protrusions 66' may be configured to have a tapered or sloped design, where the slope or taper blends smoothly into the topmost portion of sidewall 54, as illustrated in FIGS. 3A and 3B. The tapered or sloped design can facilitate alignment of an array of tubes held in plate component 10, when tray 40' is placed over the tubes to form a layer or unit. That is, the extra open space near the top of tray 40', provided by the tapered or sloped sidewall protrusions 66', in conjunction with increased lateral movement near the tops of tubes held in tray 40', enables alignment of plate, tray and tubes, thereby facilitating formation of layers or units. Conversely, the tapered or sloped design also may facilitate alignment of an array of tubes held in plate component 40', when plate 10 is placed over the tubes to form a layer or unit.

In some embodiments, sidewall 54 may have a sidewall flange 56. Sidewall flange 56 may extend outward substantially perpendicularly or substantially horizontally from sidewall 54. In some embodiments the flange may be located at the sidewall 54 terminus, opposite the tray base 42. In some embodiments the width of sidewall flange 56 may be about 1 millimeter to about 10 millimeters. For example the width of sidewall flange 56 may be about 2 millimeters, 3 millimeters, 4 millimeters, 5 millimeters, 6 millimeters, 7 millimeters, 8 millimeters, 9 millimeters, or about 10 millimeters in some embodiments. In certain embodiments, sidewall 54 may have optional sidewall tab 62, as illustrated in FIG. 2B. Sidewall tab 62 may optionally be included in manufacture of tray 40 to connect or lock units together. This feature may prove useful to allow like treated tubes to be kept together in automated machinery, or to allow additional stability during stacking or nested storage, for example. Optional sidewall tabs 62 may be configured in any desirable shape or size, depending on the required use. As illustrated in FIG. 2B, optional sidewall tabs 62 are semi-circular in shape. Optional sidewall tabs 62 of one tray can be seated over or fit onto optional sidewall tabs of another tray, thereby locking or connected the units together in an end-to-end manner. As illustrated in FIGS. 3A-3D, tray component 40' is configured without optional side tabs 62.

In certain embodiments, tray components 40 and 40' may be manufactured with or without optional support ribs 64, as illustrated in FIGS. 2C and 3C, respectively. FIG. 2C shows the optional support ribs molded into the bottom or outer surface 46 of plate base 42. Optional support ribs 64 may be used when manufacturing tray component 40 or 40' from less sturdy materials (e.g., cellulosic materials) or from thinner gauge plastics. FIG. 3C shows a bottom view of tray component 40' configured without optional support ribs 64, as would be seen in a tray manufactured from a sturdier or thicker material, for example.

In some embodiments trays 40 and 40' comprise a plastic. In certain embodiments tray 40 and 40' comprise a cellulosic material. Trays 40 and 40' also may comprise a metal in certain embodiments. In some embodiments the thickness of the plastic or metal used to form trays 40 and 40' may be about 0.5 millimeters to about 2.0 millimeters. For example, trays 40 and 40' may be formed from plastic or metal that is about 0.5 millimeters, 0.6 millimeters, 0.7 millimeters, 0.8 millimeters, 0.9 millimeters, 1.0 millimeters, 1.1 millimeters, 1.2 millimeters, 1.3 millimeters, 1.4 millimeters, 1.5 millimeters, 1.6 millimeters, 1.7 millimeters, 1.8 millimeters, 1.9 millimeters, and about 2.0 millimeters in thickness in certain embodiments. In some embodiments the thickness of the plastic, cellulosic material or metal used to form trays 40 and 40' may be in the range of about 0.2 millimeters to about 15 millimeters. For example, trays 40 and 40' may be formed from plastic that is about 0.5 millimeters, 0.6 millimeters, 0.7 millimeters, 0.8 millimeters, 0.9 millimeters, 1.0 millimeter, 1.1 millimeters, 1.2 millimeters, 1.3 millimeters, 1.4 millimeters, 1.5 millimeters, 1.6 millimeters, 1.7 millimeters, 1.8 millimeters, 1.9 millimeters, and about 2.0 millimeters in thickness, for example. In some embodiments trays 40 and 40' may be formed from cellulosic material that is about 1 millimeter, 2 millimeters, 3 millimeters, 4 millimeters, 5 millimeters, 6 millimeters, 7 millimeters, 8 millimeters, 9 millimeters, 10 millimeters, 11 millimeters, 12 millimeters, 13 millimeters, 14 millimeters, or 15 millimeters in thickness. Trays 40 and 40' also may be formed from metal that is about 0.2 millimeters, 0.3 millimeters, 0.4 millimeters, 0.5 millimeters, 0.6 millimeters, 0.7 millimeters, 0.8 millimeters, 0.9 millimeters, 1.0 millimeters, 1.1 millimeters, 1.2 millimeters, 1.3 millimeters, 1.4 millimeters, 1.5 millimeters, 2.0 millimeters, 2.5 millimeters, 3.0 millimeters, 3.5 millimeters, 4.0 millimeters, 4.5 millimeters, or about 5 millimeters in thickness, for example.

Plate 10 and trays 40 and 40' may be manufactured from plastic, cellulosic material or metal by any suitable method known for shaping plastics, polymers, wood or paper pulps and metals, including without limitation, molding, thermoforming, injection molding, and casting, for example. In some embodiments the plastic may be selected from the group consisting of polypropylene (PP), polyethylene (PE), high-density polyethylene, low-density polyethylene, polyethylene teraphthalate (PET), polyvinyl chloride (PVC), polyethylenefluoroethylene (PEFE), polystyrene (PS), high-density polystyrene, acrylnitrile butadiene styrene copolymers, and bio-plastics (e.g., bio-based platform chemicals made or derived from biological materials, such as vegetable oil (e.g., canola oil), and not from petrochemicals). In certain embodiments the plastic may be recycled PET or Bio-PET (e.g., PET made from vegetable oil, and not from petrochemicals). Bio-based plastic alternatives now exist for low and high density polyethylene (LDPE/HDPE), polypropylene (PP), polyethylene teraphthalate (PET), and polyvinyl chloride (PVC). Bio-plastic alternatives can be substituted for petroleum based plastics, where suitable, in the embodiments described herein In some embodiments the metal may be selected from the group consisting of galvanized metals (aluminum, steel, tin, and the like), surgical steel (all alloys), stainless steel (all alloys), aluminum brass, nickel, ductile iron/nickel alloys, cast iron/nickel alloys, and the like. In general, any metals with good corrosion resistance, reasonable cost, including recycled metals, and ease of manufacture may be suitable for use in embodiments described herein. In embodiments using cellulosic materials, any suitable wood or paper pulp, including without limitation, recycled paper pulps, wood pulps, or treated pulps (e.g., color additives, hardeners, coatings or slurry additives for example) may be suitable for use in embodiments described herein Molding is a process of manufacture by shaping pliable raw material using a rigid frame or model called a mold. A mold often is a hollowed-out block filled with a liquid, including, without limitation, plastic, glass, metal, or ceramic raw materials. The liquid hardens or sets inside the mold, adopting its shape. A release agent sometimes is used to facilitate removal of the hardened or set substance from the mold. In paper pulp molding, the rigid frame or mold is often made of a wire mesh. The mold is often put in contact with a vacuum source and the pulp slurry is sprayed or poured on to the frame, until no more slurry adheres. When the slurry no longer adheres, all vacuum suction has been blocked and the mold is completely covered. The slurry/mold combination is then subjected to drying, often with heat, to cause the pulp to harden. The hardened pulp product and mold are then separated. Pulp molding can produce thick walled low grade products suitable for end caps or other non-critical uses, or thin, hard walled products which resemble plastic products (e.g., transfer molded products). Both types of pulp molding use wire mesh as the mold material, however the latter method sometimes uses a fine yet sturdy wire mesh that often results in a final product with a smoother molded surface.

Thermoforming is a manufacturing process for thermoplastic sheet or film. The sheet or film is heated between infrared, natural gas, or other heaters to its forming temperature. Then it is stretched over or into a temperature-controlled, single-surface mold. The sheet is held against the mold surface unit until cooled. The formed part is then trimmed from the sheet. The trimmed material is usually reground, mixed with virgin plastic, and reprocessed into usable sheet. There are several categories of thermoforming, including vacuum forming, pressure forming, twin-sheet forming, drape forming, free blowing, and simple sheet bending.

Wood and paper pulp may also be thermoformed. The technique produces a material referred to as thermoformed fiber. This newest form of molded pulp uses a process called "Cure-In-The-Mold" technology, which produces high quality, strong, well defined smooth surfaced molded pulp products. After being formed, the product is captured in heated forming molds that compress the molded products. The products are ejected from the heated molds in their finished state as opposed to being dried in a heated oven, as with paper molding for example. The resultant products are accurately formed and have the appearance of plastic material.

Injection molding is a manufacturing technique for making parts from both thermoplastic and thermosetting plastic materials in production. Molten plastic is injected at high pressure into a mold. Molds may be made from either steel or aluminum, and precision-machined to form the features of the desired part.

Casting is a manufacturing process by which a liquid material generally is flowed into a mold, which contains a hollow cavity of the desired shape, and then the liquid material is allowed to solidify.

The solid casting is then ejected or broken out to complete the process. Casting may be used to form hot liquid metals or various materials that cold set after mixing of components (such as epoxies, concrete, plaster and clay). Casting is most often used for making complex shapes that would be otherwise difficult or uneconomical to make by other methods. The casting process is subdivided into two distinct subgroups: expendable and non-expendable mold casting.

Expendable mold casting is a generic classification that includes sand, plastic, shell, plaster, and investment (lost-wax technique) moldings. This method of mold casting involves the use of temporary, non-reusable molds. Non-expendable mold casting differs from expendable processes in that the mold need not be reformed after each production cycle. This technique includes at least four different methods: permanent, die, centrifugal, and continuous casting.

Methods of Use

Tube loading system embodiments described herein enable rapid loading, manipulating and handling of tubes. The plate 10 and tray 40 components enable rapid loading of tubes by contacting a first layer of tubes with a plate and a tray, orienting the first layer of tubes with the open top of each tube facing upwards and the tube bottoms in the wells of tray 40, and disengaging the plate from the first layer of tubes.

In some embodiments a first layer of tubes and plate 10 may first be contacted, followed by contact with tray 40. In some embodiments a first layer of tubes and tray 40 may first be contacted, followed by contact with plate 10. Contact or engagement of tubes with tube loading system plate component 10 and/or tray component 40 may be accomplished using a variety of means known to one of skill in the art, a tube feeder or delivery system temporarily placed in effective communication with tray component 40, for example.

In some embodiments in which plate 10 is first contacted or engaged with a first layer of tubes, the tubes are delivered to the inner surface 14 of plate 12, in the correct orientation (open side down), and are seated over inner surface projections 18 by sliding engagement of tubes against inner surface projections 18 and against other tubes. The tube and plate combination may then be placed in contact with a tray. The tray may be seated on the tubes and plate 10 by placing tray perimeter sidewall 54 in contact with a row of tubes on the perimeter of the tube array, and pressing the tray downwards. In some embodiments optional rocking or shaking may be applied with downward pressure to facilitate seating of tray 40 on the tubes and plate 10.

In some embodiments in which tray 40 is first contacted or engaged with a first layer of tubes, the tubes are delivered to the inner surface 44 of tray 42, in the correct orientation (bottom down) and negotiate the inner surface projections 48 and are thereby seated in the wells of tray 42 formed by the juxtaposition of the trays inner surface projections 48. The tube and tray combination may then be placed in contact with a plate. The plate may be seated by placing a row of inner surface projections in contact with the open tops of the tubes seated in tray 40. The action of the inner surface projections 18 aligning tubes as the inner surface projections 18 of plate 10 insertionally engage the tops of the open tubes in the layer, may cause additional tube movement further enabling rapid settling of plate component 10.

Once tubes are loaded within a tray and plate, the layer or unit may be reoriented (rotated, flipped, turned) so that the open tops of tubes face up. When desired plate 10 may be disengaged to allow access to a layer of properly oriented tubes. In some embodiments the tubes may be reoriented by automated or robotic arm means, hydraulic, ratchet-type or gear drive clamps or mini forklifts, for example. In embodiments with two or more layers of tubes and a plate for each layer of tubes, the engaging, orienting and disengaging steps may be repeated for each layer of tubes. In embodiments with two or more layer of tubes and a plate and tray for each layer of tubes, the engaging, orienting and disengaging steps may be repeated for each layer of tubes. In some embodiments plate 10 may be disengaged to enable addition of various liquids or solids suitable for use in various laboratory or clinical settings including, without limitation, cell culturing nutrients (solid or liquid form), insect farming nutrients and supplies, scintillation counting fluids, blood collection additives (anti-coagulation agents, separating agents, analysis reagents), materials for isolation, purification and analysis of biomolecules, and the like. Automated devices, such as biological workstations for example, compatible with tube loading system embodiments described herein, may facilitate addition of the materials above, in some embodiments. After addition of the desired material, plate 10 may be re-engaged to enable nested stacking of the prepared tubes.

EXAMPLES

Provided hereinafter are examples of embodiments that illustrate, and do not limit, the invention.

A1. A tube loading system, which comprises:
- a first layer of tubes in an array, wherein each tube comprises a top, a bottom and one or more walls; and
- a plate comprising a base having an inner surface and an outer surface, a first set of projections extending from the inner surface, and a second set of projections extending from the outer surface, wherein:
- each of the projections in the first set, or portion thereof, is in effective connection with the top of each tube in the layer, and
- the first set of projections positions tubes of the first layer in the array.

A2. The system of embodiment A1, wherein each projection of the first set is isolated from other projections in the first set.

A3. The system of embodiment A1 or A2, wherein each projection of the second set is isolated from other projections in the second set.

A4. The system of any one of embodiments A1-A3, wherein each projection of the second set is in effective connection with the bottom of two or more tubes in an optional second layer of tubes in stacked connection with the outer surface of the base.

A5. The system of any one of embodiments A1-A4, wherein the plate comprises a sidewall extending from the inner surface of the base and surrounding the base perimeter.

A6. The system of embodiment A5, wherein the sidewall is in connection with a flange that extends from the sidewall.

A7. The system of embodiment A5 or A6, wherein a portion of the plate sidewall is in effective contact with a wall of a tube located on the perimeter of the array.

A8. The system of any one of embodiments A5-A7, wherein the plate sidewall includes one or more curved portions and wherein each curved portion has a radius of curvature that can accommodate the radius of curvature of a circular cross section tube.

A9. The system of any one of embodiments A1-A8, wherein each projection in the first set includes one or more surfaces in effective contact with the top of a tube in the first layer.

A10. The system of embodiment A9, wherein each projection in the first set includes one or more surfaces in effective contact with an inner surface of a tube in the first layer.

A11. The system of any one of embodiments A1-A10, wherein each projection in the second set includes one or more curved surfaces having a radius of curvature that can accommodate the radius curvature of a circular cross section tube.

A12. The system of any one of embodiments A1-A11, wherein:
- each projection in the second set comprises one or more surfaces and a terminus opposite the base, and
- the one or more surfaces taper as they extend from the base to the terminus.

A13. The system of embodiment A12, wherein each projection is conical.

A14. The system of embodiment A12, wherein each projection comprises three or more axial edges.

A15. The system of embodiment A14, wherein each projection comprises four axial edges.

A16. The system of embodiment A14 or A15, wherein the surfaces between the edges are curved.

A17. The system of embodiment A16, wherein the curved surfaces are concave.

A18. The system of any one of embodiments A1-A17, wherein the base is substantially rectangular.

A19. The system of any one of embodiments A1-A17, wherein the base is substantially square.

A20. The system of any one of embodiments A1-A19, wherein the tops of the tubes face downwards.

A21. The system of any one of embodiments A1-A20, wherein the tubes comprise a plastic.

A22. The system of any one of embodiments A1-A21, wherein the plate comprises a plastic.

A23. The system of embodiment A22, wherein the plate consists of a plastic.

A24. The system of any one of embodiments A21-A23, wherein the plastic is selected from the group consisting of polypropylene (PP), polyethylene (PE), high-density polyethylene, low-density polyethylene, polyethylene teraphthalate (PET), polyvinyl chloride (PVC), polyethylene-fluoroethylene (PEFE), polystyrene (PS), high-density polystyrene, acrylnitrile butadiene styrene copolymers and bio-plastic.

A25. The system of embodiment A24, wherein the plastic is recycled PET or bio-PET.

A26. The system of any one of embodiments A22-A25, wherein the plate is thermoformed.

A27. The system of any one of embodiments A1-A26, which comprises two or more layers of tubes and a plate in effective connection with each layer.

A28. The system of embodiment A27, wherein the system includes five or more layers of tubes.

A29. The system of embodiment A27, wherein the system includes ten or more layers of tubes.

A30. The system of embodiment A27, wherein the system includes fifteen or more layers of tubes.

A31. The system of embodiment A27, wherein the system includes twenty or more layers of tubes.

A32. The system of embodiment A27, wherein the system includes twenty-five or more layers of tubes.

A33. the system of any one of embodiments A27-A32, wherein the axial centerlines of tubes in one layer align with the axial centerlines of tubes of another layer.

A34. The system of any one of embodiments A1-A33, which comprises a tray that includes a tray base having an inner surface and an outer surface, and a first set of tray projections extending from the inner surface of the tray base, wherein:

each of the projections is in effective contact with the bottom of two or more tubes in an optional layer of tubes, and the projections position the tubes in the array.

A35. The system of embodiment A34, wherein one or more of the trays is between one or more layers of tubes.

A36. The system of embodiment A34, wherein the tray is contact with the top layer of tubes.

A37. The system of any one of embodiments A34-A36, wherein:

each tray projection in the first set of tray projections comprises one or more surfaces and a terminus opposite the tray base, and the one or more surfaces taper as they extend from the tray base to the terminus.

A38. The system of embodiment A37, wherein each tray projection is conical.

A39. The system of embodiment A37, wherein each tray projection comprises three or more axial edges.

A40. The system of embodiment A39, wherein each tray projection comprises four axial edges.

A41. The system of embodiment A39 or A40, wherein the surfaces between the edges are curved.

A42. The system of embodiment A41, wherein the curved surfaces are concave.

A43. The system of any one of embodiments A34-A42, wherein the tray comprises a plastic.

A44. The system of embodiment A43, wherein the tray consists of a plastic.

A45. The system of embodiment A43 or A44, wherein the plastic is selected from the group consisting of polypropylene (PP), polyethylene (PE), high-density polyethylene, low-density polyethylene, polyethylene teraphthalate (PET), polyvinyl chloride (PVC), polyethylenefluoroethylene (PEFE), polystyrene (PS), high-density polystyrene, acrylnitrile butadiene styrene copolymers and bio-plastic.

A46. The system of embodiment A45, wherein the plastic is recycled PET or bio-PET.

A47. The system of any one of embodiments A43-A46, wherein the tray is thermoformed.

A48. The system of any one of embodiments A43-A46, wherein the tray comprises a sidewall surrounding the base perimeter.

A49. The system of anyone of embodiments A1-A48, wherein the terminus of each projection is flat.

A50. The system of any of embodiments A1-A49, wherein the plate, the tray or both the plate and tray comprise a cellulosic material.

A51. The system of any of embodiments A1-A50, wherein the tray sidewall has an inner surface.

A52. The system of any of embodiments A1-A51, wherein the tray sidewall comprises protrusions extending from the sidewall inner surface.

A53. The system of any of embodiments A1-A52, wherein the tray sidewall protrusions are sloped or tapered.

A54. The system of embodiment 53, wherein the sloped or tapered protrusions blend smoothly into the top of the inner sidewall surface.

B1. A plate that can orient tubes for a tube loading system in an array, which comprises a base having an inner surface and an outer surface, a first set of projections extending from the inner surface, and a second set of projections extending from the outer surface, wherein:

each of the projections in the first set is in effective connection with the top of each tube in an optional first layer of tubes, and the first set of projections positions the optional first layer of tubes in an array.

B2. The plate of embodiment B1, wherein:

each projection in the second set comprises one or more surfaces and a terminus opposite the base, and the one or more surfaces taper from the base to the terminus.

B3. The plate of embodiment B2, wherein each projection is conical.

B4. The plate of embodiment B2, wherein each projection comprises three or more axial edges.

B5. The plate of embodiment B4, wherein each projection comprises four axial edges.

B6. The plate of embodiment B4 or B5, wherein the surfaces between the edges are curved.

B7. The plate of embodiment B6, wherein the curved surfaces are concave.

B8. The plate of any one of embodiments B1-B7, wherein the base is substantially rectangular.

B9. The plate of any one of embodiments B1-B7, wherein the base is substantially square.

B10. The plate of any one of embodiments B1-B9, which comprises a plastic.

B11. The plate of embodiment B10, which consists of a plastic.

B12. The plate of embodiment B10 or B11, wherein the plastic is selected from the group consisting of polypropylene (PP), polyethylene (PE), high-density polyethylene, low-density polyethylene, polyethylene teraphthalate (PET), polyvinyl chloride (PVC), polyethylenefluoroethylene (PEFE), polystyrene (PS), high-density polystyrene, acrylnitrile butadiene styrene copolymers and bio-plastic.

B13. The plate of embodiment B12, wherein the plastic is recycled PET or bio-PET.

B14. The plate of any one of embodiments B1-B13, which is thermoformed.

B15. The plate of any one of embodiments B1-B14, wherein each projection of the first set is isolated from other projections in the first set.

B16. The plate of any one of embodiments B1-B15, wherein each projection of the second set is isolated from other projections in the second set.

B17. The plate of any one of embodiments B1-B16, wherein each projection of the second set is in effective connection with the bottom of two or more tubes in an optional second layer of tubes in stacked connection with the outer surface of the plate.

B18. The plate of any one of embodiments B1-B17, which comprises a sidewall surrounding the perimeter of the base.

B19. The plate of embodiment B18, wherein the sidewall extends from the inner surface of the base.

B20. The plate of embodiment B18 or B19, wherein the sidewall is in connection with a flange that extends from the sidewall.

B21. The plate of any one of embodiments B1-B20, wherein the terminus of each projection is flat.

B22. The plate of any one of embodiments B1-B21, wherein the plate comprises a cellulosic material.

C1. A tray that can orient a layer of tubes in an array, which comprises:

a tray base having an inner surface and an outer surface, and a first set of tray projections extending from the inner surface of the base, wherein:

each of the projections is in effective contact with the bottom of two or more tubes in an optional layer of tubes, and the projections position the tubes in an array.

C2. The tray of embodiment C1, which comprises a second set of projections extending from the outer surface of the base.

C3. The tray of embodiment C1 or C2, wherein:

each tray projection in the first set of tray projections comprises one or more surfaces and a terminus opposite the tray base, and the one or more surfaces taper as they extend from the tray base to the terminus.

C4. The tray of embodiment C3, wherein each tray projection is conical.

C5. The tray of embodiment C3, wherein each tray projection comprises three or more axial edges.

C6. The tray of embodiment C5, wherein each tray projection comprises four axial edges.

C7. The tray of embodiment C5 or C6, wherein the surfaces between the edges are curved.

C8. The tray of embodiment C7, wherein the curved surfaces are concave.

C9. The tray of any one of embodiments C1-C8, wherein the tray comprises a plastic.

C10. The tray of embodiment C9, wherein the tray consists of a plastic.

C11. The tray of embodiment C9 or C10, wherein the plastic is selected from the group consisting of polypropylene (PP), polyethylene (PE), high-density polyethylene, low-density polyethylene, polyethylene teraphthalate (PET), polyvinyl chloride (PVC), polyethylenefluoroethylene (PEFE), polystyrene (PS), high-density polystyrene, acrylnitrile butadiene styrene copolymers and bio-plastic.

C12. The tray of embodiment C11, wherein the plastic is recycled PET or bio-PET.

C13. The tray of any one of embodiments C9-C12, wherein the tray is thermoformed.

C14. The tray of any one of embodiments C1-C13, wherein each tray projection of the first set is isolated from other tray projections in the first set.

C15. The tray of any one of embodiments C1-C14, wherein each tray projection of the second set is isolated from other tray projections in the second set.

C16. The tray of any one of embodiments C1-C15, which comprises a sidewall surrounding the perimeter of the tray base.

C17. The tray of embodiment C16, wherein the tray sidewall extends from the inner surface of the tray base.

C18. The tray of embodiment C16 or C17, wherein the tray sidewall is in connection with a flange that extends from the tray sidewall.

C19. The tray of any one of embodiments C1-C18, wherein the tray comprises a cellulosic material.

C20. The tray of any one of embodiments C1-B19, wherein the terminus of each projection is flat.

C21. The tray of any one of embodiments C1-C20, wherein the tray sidewall has an inner surface.

C22. The tray of any one of embodiments C1-C21, wherein the tray sidewall comprises protrusions extending from the sidewall inner surface.

C23. The tray of any one of embodiments C1-C22, wherein the tray sidewall protrusions are sloped or tapered.

C24. The tray of embodiment 23, wherein the sloped or tapered protrusions blend smoothly into the top of the inner sidewall surface.

D1. A method for loading an array of tubes in a tray, which comprises:

(a) contacting a first layer of tubes with a plate and tray wherein:

each tube comprises a top, bottom and one or more walls, the first layer of tubes is in contact with a plate comprising a base having an inner surface and an outer surface, a first set of projections extending from the inner surface and a second set of projections extending from the outer surface, each of the projections in the first set is in effective connection with the top of each tube in the first layer, each projection of the first set is isolated from other projections in the first set, the bottom of each tube in the first layer of tubes is in contact with the tray, and the top of each tube is facing downwards and the tubes are between the plate and the tray;

(b) orienting the first layer of tubes with the top of each tube facing upwards; and (c) disengaging the plate from the first layer of tubes, whereby the first layer of tubes is loaded in the tray.

D2. The method of embodiment D1, wherein there are two or more layers of tubes and a plate for each layer of tubes, and (a), (b) and (c) are repeated for each layer of tubes.

D3. The method of embodiment D1 or D2, which is further defined or limited by an applicable embodiment described above in A2-A54, B2-B22, or C2-C24.

The entirety of each patent, patent application, publication and document referenced herein hereby is incorporated by reference. Citation of the above patents, patent applications, publications and documents is not an admission that any of the foregoing is pertinent prior art, nor does it constitute any admission as to the contents or date of these publications or documents.

Modifications may be made to the foregoing without departing from the basic aspects of the invention. Although the invention has been described in substantial detail with reference to one or more specific embodiments, those of ordinary skill in the art will recognize that changes may be made to the embodiments specifically disclosed in this application, yet these modifications and improvements are within the scope and spirit of the invention.

The invention illustratively described herein suitably may be practiced in the absence of any element(s) not specifically disclosed herein. Thus, for example, in each instance herein any of the terms "comprising," "consisting essentially of," and "consisting of" may be replaced with either of the other two terms. The terms and expressions, which have been employed, are used as terms of description and not of limitation, and use of such terms and expressions do not exclude any equivalents of the features shown and described or portions thereof, and various modifications are possible within the scope of the invention claimed. The term "a" or "an" can refer to one of or a plurality of the elements it modifies (e.g., "a reagent" can mean one or more reagents) unless it is contextually clear either one of the elements or more than one of the elements is described. The term "about" as used herein refers to a value within 10% of the underlying parameter (i.e., plus or minus 10%), and use of the term "about" at the beginning of a string of values modifies each of the values (i.e., "about 1, 2 and 3" is about 1, about 2 and about 3). For example, a weight of "about 100 grams" can include weights between 90 grams and 110 grams. Thus, it should be understood that although the present invention has been specifically disclosed by representative embodiments and optional features, modification and variation of the concepts herein disclosed may be resorted to by those skilled in the art, and such modifications and variations are considered within the scope of this invention.

Embodiments of the invention are set forth in the claims that follow.

What is claimed is:

1. A tube loading system, which comprises:

a first layer of tubes in an array, wherein each tube comprises a top, a bottom, one or more walls, and an inner surface;

a plate comprising a base having a plate inner surface and a plate outer surface, a first set of plate projections extending from the plate inner surface, and a second set of projections extending from the plate outer surface, wherein:

each projection in the first set of the plate projections includes one or more surfaces in effective contact with an inner surface of a tube in the first layer, and the first set of plate projections positions tubes of the first layer in the array; and a second layer of tubes in stacked connection with the outer surface of the base, wherein each projection of the second set of plate projections is in effective connection with the bottom of two or more tubes in the second layer of tubes.

2. The system according to claim 1, which comprises two or more layers of tubes and a plate in effective connection with each of the layers of tubes.

3. The system according to claim 1, wherein each projection of the first set of plate projections is isolated from other projections in the first set of plate projections, and further wherein each projection of the second set of plate projections is isolated from other projections in the second set of plate projections.

4. The system according to claim 1, wherein the plate comprises a sidewall and a base perimeter wherein the sidewall extends from the inner surface of the base and surrounds the base perimeter.

5. The system according to claim 4, wherein a portion of the plate sidewall is in effective contact with a wall of a tube located on the perimeter of the array, and further wherein the plate sidewall includes one or more curved portions and wherein each curved portion has a radius of curvature that can accommodate the radius of curvature of a circular cross section tube.

6. The system according to claim 1, wherein each projection in the second set of plate projections includes one or more curved surfaces having a radius of curvature that can accommodate the radius curvature of a circular cross section tube.

7. The system according to claim 1, wherein:

each projection in the second set of plate projections comprises one or more surfaces and a terminus opposite the base, and the one or more surfaces taper as they extend from the base to the terminus.

8. The system according to claim 7, wherein the terminus of each projection is flat.

9. The system according to claim 7, wherein each projection is conical.

10. The system according to claim 1, wherein each projection comprises three or more axial edges, and wherein the surfaces between the edges are curved.

11. The system according to claim 1, which comprises a tray that includes a tray base having a tray inner surface and a tray outer surface, and a first set of tray projections extending from the inner surface of the tray base, wherein:

each of the tray projections is in effective contact with the bottom of two or more tubes in the layer of tubes, and the tray projections position the tubes in the array.

12. The system according to claim 11, wherein one or more of the trays is between one or more layers of tubes.

13. The system according to claim 11, wherein:

each tray projection in the first set of tray projections comprises one or more surfaces and a terminus opposite the tray base, and the one or more surfaces taper as they extend from the tray base to the terminus.

14. The system according to claim 13, wherein each tray projection is conical.

15. The system according to claim 13, wherein each tray projection comprises three or more axial edge and the surfaces between the edges are curved.

16. The system according to claim 11, wherein the plate, the tray or both the plate and tray comprise a cellulosic material.

17. The system according to claim 11, wherein the plate, the tray or both the plate and tray comprise a plastic.

18. The system according to claim 17, wherein the plastic is selected from the group consisting of polypropylene, high-density polyethylene, low-density polyethylene, polyethylene teraphthalate, polyvinyl chloride, polyethylenefluoroethylene, polystyrene, high-density polystyrene, acrylnitrile butadiene styrene copolymers, and bio-plastics.

19. The system according to claim 18, wherein the plastic is recycled PET or bio-PET.

20. The system according to claim 11, wherein the plate, the tray or the plate and tray are thermoformed.

21. The system according to claim 1, wherein a tube is a vial.

22. The system according to claim 1, wherein a tube is a container.

* * * * *